US007032795B2

(12) United States Patent
Adams et al.

(10) Patent No.: US 7,032,795 B2
(45) Date of Patent: Apr. 25, 2006

(54) STAPLER FOR FORMING STAPLES TO VARIOUS SIZES

(75) Inventors: David P. Adams, Barrington, IL (US); Kenneth J. Bargo, Chicago, IL (US); Valentin Fridmanovich, Forest Hills, NY (US)

(73) Assignee: ACCO Brands USA LLC, Lincolnshire, IL (US)

( * ) Notice: Subject to any disclaimer, the term of this patent is extended or adjusted under 35 U.S.C. 154(b) by 0 days.

(21) Appl. No.: 11/028,087

(22) Filed: Jan. 3, 2005

(65) Prior Publication Data

US 2005/0116007 A1 Jun. 2, 2005

Related U.S. Application Data

(60) Division of application No. 10/600,495, filed on Jun. 20, 2003, now Pat. No. 6,871,768, which is a continuation-in-part of application No. 09/590,283, filed on Jun. 11, 1999, now Pat. No. 6,739,492.

(60) Provisional application No. 60/138,601, filed on Jun. 11, 1999.

(51) Int. Cl.
*B25C 5/04* (2006.01)

(52) U.S. Cl. ..... 227/82; 227/88; 227/109

(58) Field of Classification Search ..... 227/82, 227/88, 91, 93, 97, 109, 155
See application file for complete search history.

(56) References Cited

U.S. PATENT DOCUMENTS

| | | | |
|---|---|---|---|
| 1,810,528 | A | 6/1931 | Peterson |
| 1,996,222 | A | 4/1935 | Vogel |
| 2,635,234 | A | 4/1953 | Reed |
| 2,987,729 | A | 6/1961 | Taynton |
| 3,347,439 | A | 10/1967 | Doherty |
| 3,504,837 | A | 4/1970 | Cairatti |
| 3,642,187 | A | 2/1972 | Barland |
| 3,958,738 | A | 5/1976 | Tremblay |
| 4,318,555 | A | 3/1982 | Adamski et al. |
| 4,378,085 | A | 3/1983 | McVeigh |
| 4,421,264 | A | 12/1983 | Arter et al. |
| 4,583,276 | A | 4/1986 | Olesen |
| 4,693,407 | A | 9/1987 | Buck et al. |
| 5,004,142 | A | 4/1991 | Olesen |
| 5,007,483 | A | 4/1991 | McGuire |
| 5,076,483 | A | 12/1991 | Olesen |
| 5,147,080 | A | 9/1992 | Assink et al. |
| 5,516,025 | A | 5/1996 | Eriksson |
| 5,639,007 | A | 6/1997 | Nakamura |
| 5,931,365 | A | 8/1999 | Huang |
| 6,076,720 | A | 6/2000 | Deng |
| 6,547,230 | B1 | 4/2003 | Sato |
| 6,557,744 | B1 | 5/2003 | Kitamura |
| 2004/0020963 | A1 | 2/2004 | Sesek et al. |

FOREIGN PATENT DOCUMENTS

| | | |
|---|---|---|
| JP | 7-187487 | 7/1996 |

*Primary Examiner*—Scott A. Smith
*Assistant Examiner*—Gloria R. Weeks
(74) *Attorney, Agent, or Firm*—Michael Best & Friedrich LLP

(57) ABSTRACT

A staple forming mechanism having at least first and second configurations. The staple forming mechanism including a bend surface having a first surface width in the first configuration and a second surface width in the second configuration for forming staples having first and second crown sizes, respectively. The forming mechanism also includes at least two side portions spaced apart by a first former width in the first configuration and by a second former width in the second configuration. The side portions cooperate with the bend surface to form the staples. A stapler includes the forming mechanism and a driver including a driving surface having a first driver width in the first configuration and a second driver width in the second configuration for driving the staples of the first and second crown sizes into a stack of papers.

25 Claims, 25 Drawing Sheets

STAPLER FOR FORMING STAPLES TO VARIOUS SIZES

RELATED APPLICATIONS

This application is a divisional of co-pending U.S. patent application Ser. No. 10/600,495 filed Jun. 20, 2003, now U.S. Pat. No. 6,871,768 which is a continuation-in-part of U.S. patent application Ser. No. 09/590,283 filed Jun. 11, 1999, now U.S. Pat. No. 6,739,492, which was converted to a non-provisional application from U.S. Provisional Patent Application No. 60/138,601 filed Jun. 11, 1999.

BACKGROUND OF THE INVENTION

Standard size staples have been used to staple stacks of paper, or other material, within predetermined ranges of stack thicknesses. In general, staples with longer legs are needed to staple thicker stacks than can be stapled with staples that have shorter legs. Standard staple sizes, for example, are configured for stapling ranges of stacks from 2 to 30 sheets or 30 to 70 sheets.

U.S. Pat. No. 4,318,555 teaches a stapler that cuts and forms staples from a continuous supply of wire. The height of the stack to be stapled is sensed, and the length of the wire to be cut is selected accordingly. The cut blank is then formed into a staple, which is then driven into the sheets to be stapled. As different wire lengths are selected, the staple is formed with legs of varying length, and a crown of a constant length.

U.S. Pat. Nos. 4,583,276 and 5,007,483 show staplers that employ the cartridge that includes a belt of straight, flat staple blanks. The belt is fed to a former which bends the blanks to a single size. A driver then drives the formed staple towards an anvil with clinching grooves or clinching wings to bend the staple legs against the stack.

SUMMARY OF THE INVENTION

The invention is related to a stapler that can feed a staple blank of a predetermined length and form the blank into a staple selectably with a smaller or larger crown size, and preferably with corresponding larger or smaller leg length. Thus, a single source of staple blanks can be used to staple a large range of stack sizes, by varying the configuration of the staple produced.

DETAILED DESCRIPTION OF THE PREFERRED EMBODIMENTS

Figure 1:
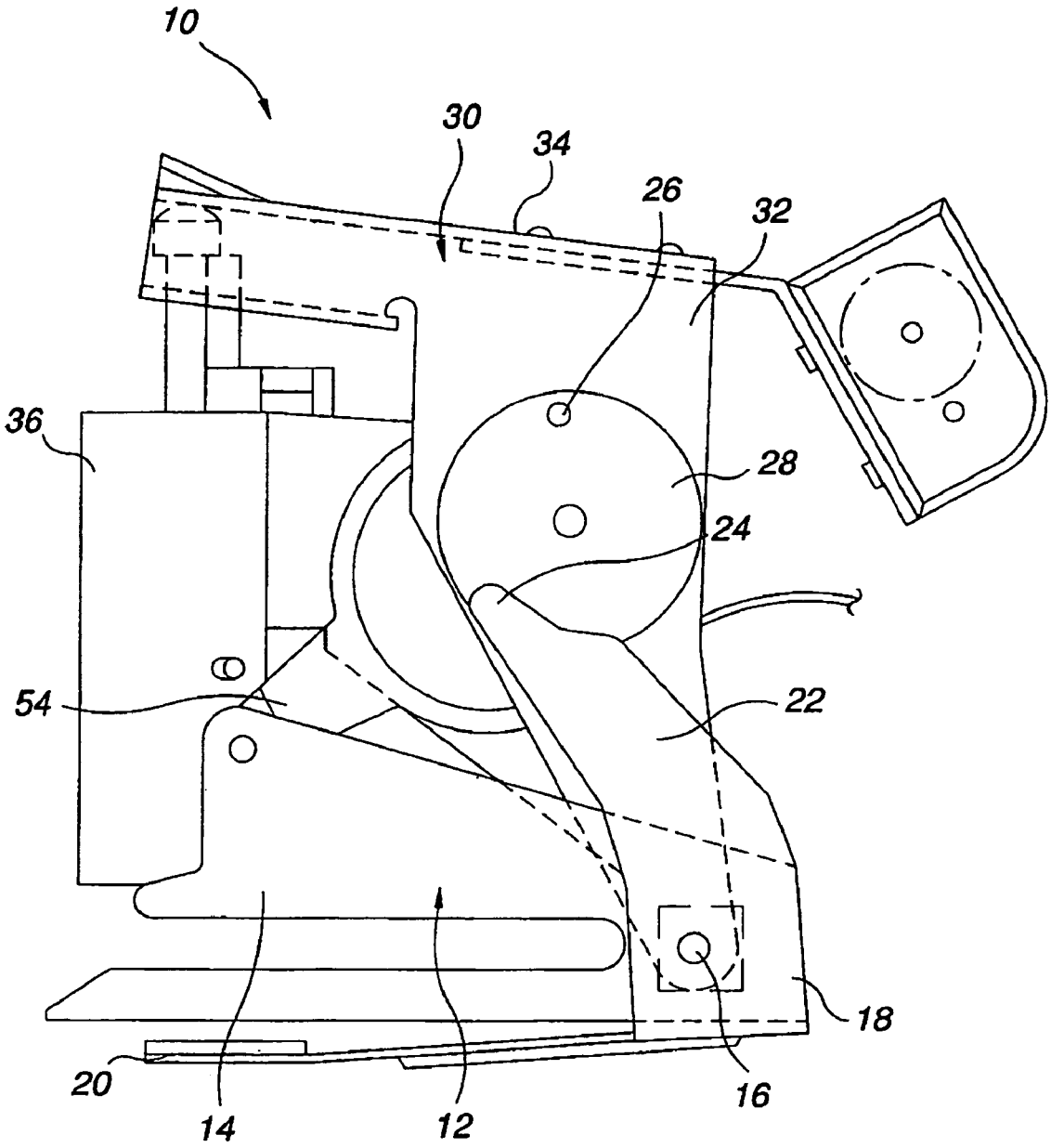
FIG. 1 is a side view of a preferred embodiment of a stapler constructed according to the invention.

Referring to FIG. 1, a preferred embodiment of a stapler 10 constructed according to the invention has a base frame 12 which can be secured to a housing or secured within another apparatus such as a photocopy machine. The frame 12 has side pieces 14, which may be constructed as disclosed in U.S. Pat. No. 5,076,483, which is hereby incorporated by reference. Axle 16 is received in holes in the side pieces, and is preferably held by round clinch washers located in mount recesses of the axle 16. Frame 12 also carries pivotable clinch member actuator 18. Clinch actuator 18 includes a kicker plate 20 and up-standing side pieces 22 with a cam lobe 24 to engage exterior cam pins 26 carried on cam 28 to cause, as explained below, partial rotation upwards and downwards of the actuator unit 18 for actuating clinching members. In this application, descriptions related to horizontal or vertical positions, or upward, downward, or sideways directions, and other such orientational references are made with respect to the position of the stapler of parts thereof in the drawings. It should be understood that the stapler of each embodiment may be used in different orientations.

Drive control unit 30, also pivotally mounted about axle 16, includes two side frame pieces 32 and a top piece 34. The preferred stapler 10 also has a staple head, also pivotally mounted about axle 16, which houses a driving and forming mechanism.

Figure 2:
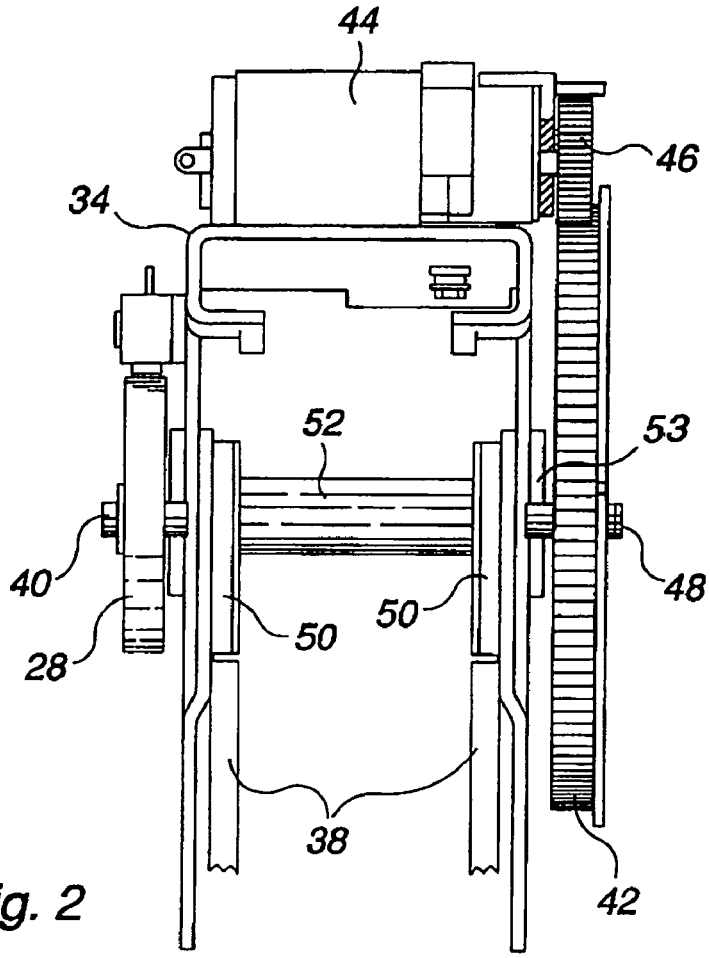
FIG. 2 is a partial top view thereof.
Figure 3:
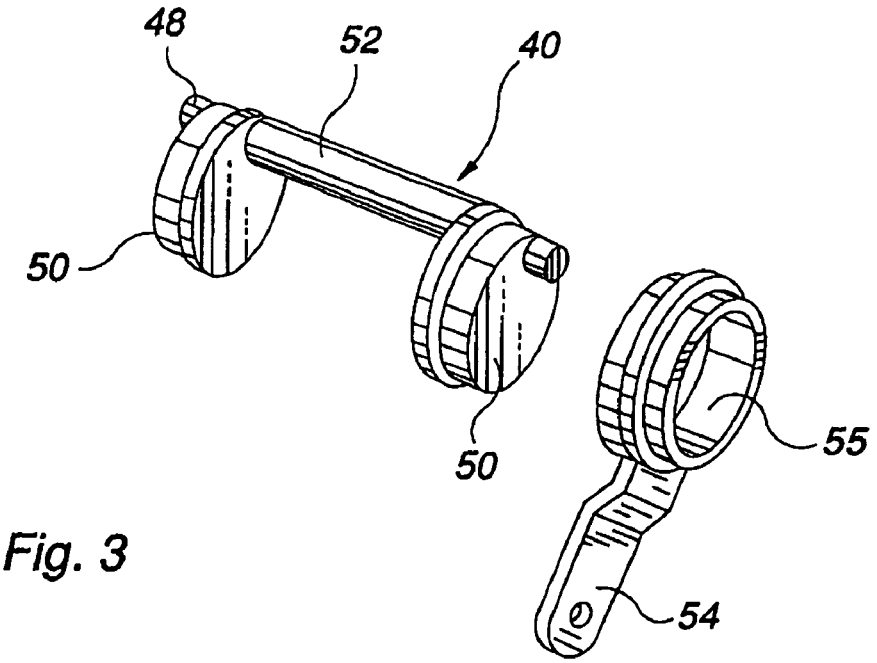
FIG. 3 is an exploded view of a portion of the actuating mechanism of the stapler.

Referring to FIG. 2, head 36 has two spaced apart sides 38. Drive control unit 30 is driven up and down preferably by a dumbbell-arm eccentric 40, which in turn is rotated by bull gear 42.

A top piece 34 supports motor 44, spur gear 46 and bull gear 42. Dumbbell unit 40 rotates about shaft 48 with disks 50, preferably formed as one integral piece with cross tube 52. One of the disks 50 is preferably interlocked through lock piece 53 to bull gear 42. Cam 28 and the other disk 50 rotate together about the axle 48. Arms 54 have eyelet openings 55 surrounding disks 50. An alternative actuating mechanism, in which arms of the stapling mechanism are driven by a pin engaged in follower slots is shown in U.S. Pat. No. 5,413,266, which is hereby incorporated by reference. Other actuating mechanisms include independent motors or other mechanisms as would be understood by those of ordinary skill in the art.

Figure 4:
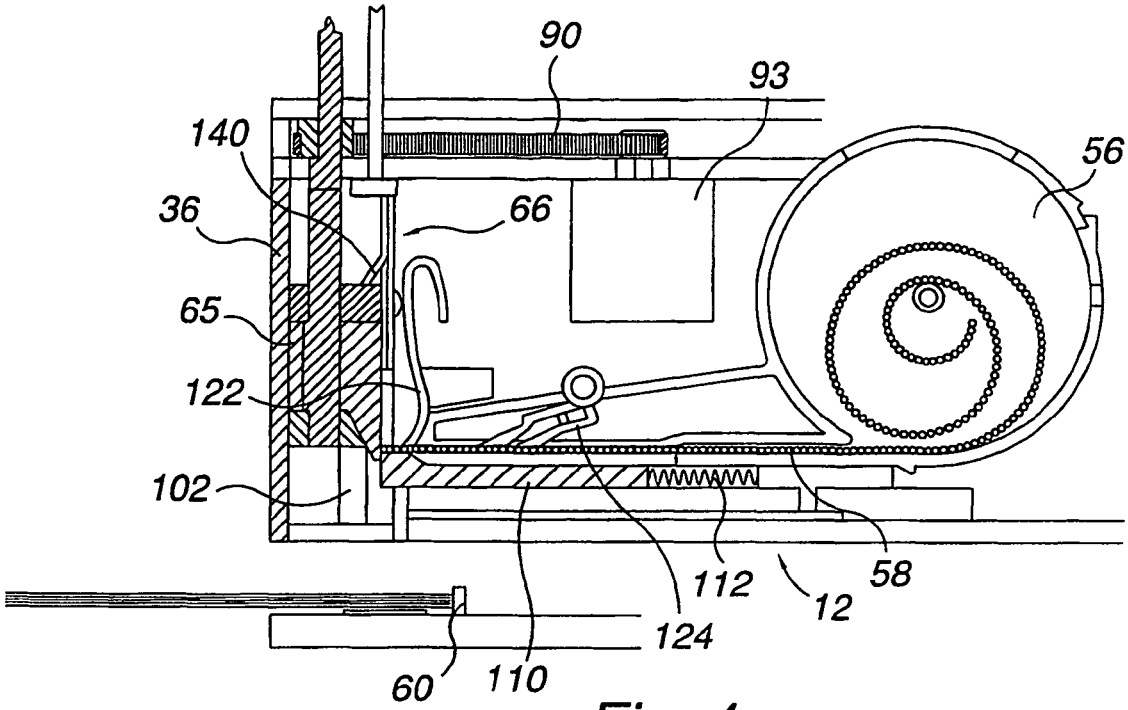
FIGS. 4 and 5 are side cross-sectional views of former/driver assemblies of the stapler.
Figure 5:
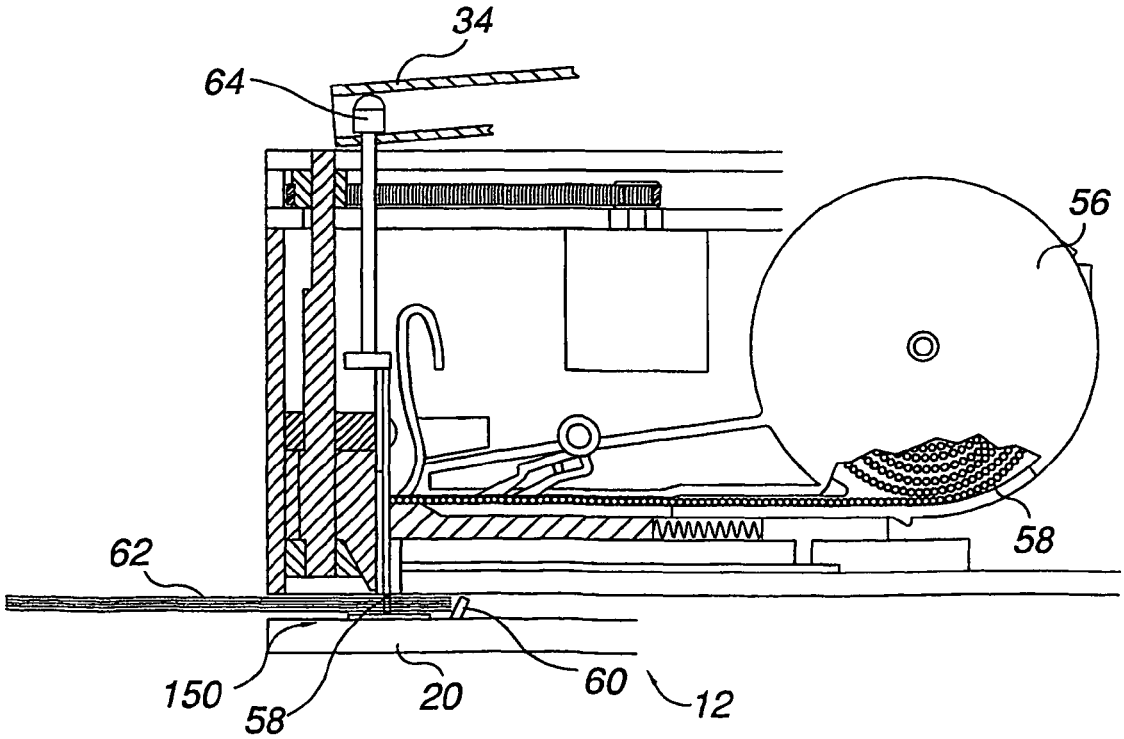

Referring to FIGS. 4 and 5, cartridge 56 is loaded into the stapler. The cartridge preferably has a band of staple blanks 58 in a roll. Other embodiments may employ short stacked strips of staple blanks, as known in the art, or other feed mechanisms to deliver staple blanks to the former/driver mechanism. To staple a stack, as shown in FIG. 5, motor 44 rotates spur gear 46 when a trip switch 60 is pressed by a stack of papers or other material to be stapled 62, and spur gear 46 rotates bull gear 42, causing dumbbell arm-eccentric 40 to turn about shaft 48. As dumbbell arm-eccentric 40 rotates, it causes eccentric plastic disks 50 to turn, causing drive control unit 30 to swing downwardly about axle 16. As the drive control unit 30 moves downwardly, the head 36 is also pivoted downwardly towards the stack 62, and top piece 34 presses against driver actuator 64.

Figure 6A:
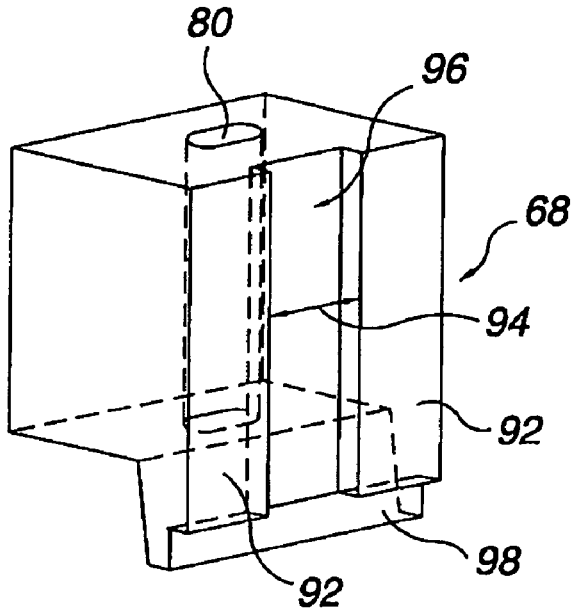
FIG. 6 is an exploded view of portions of a former of the stapler.
Figure 6B:
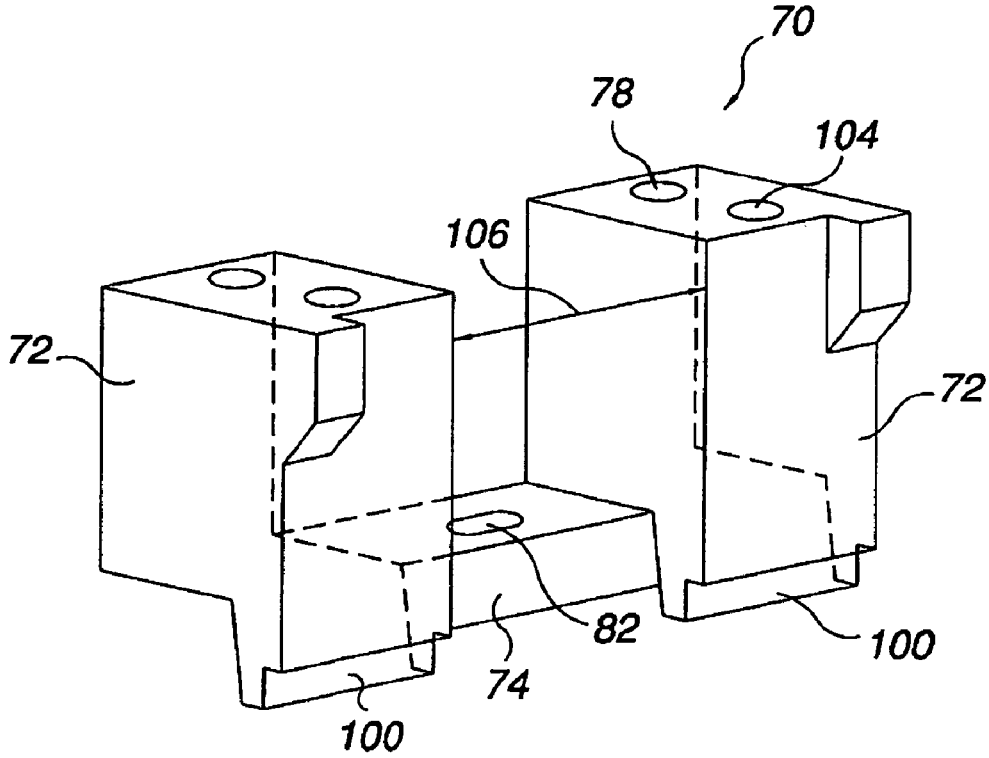
Figure 7A:
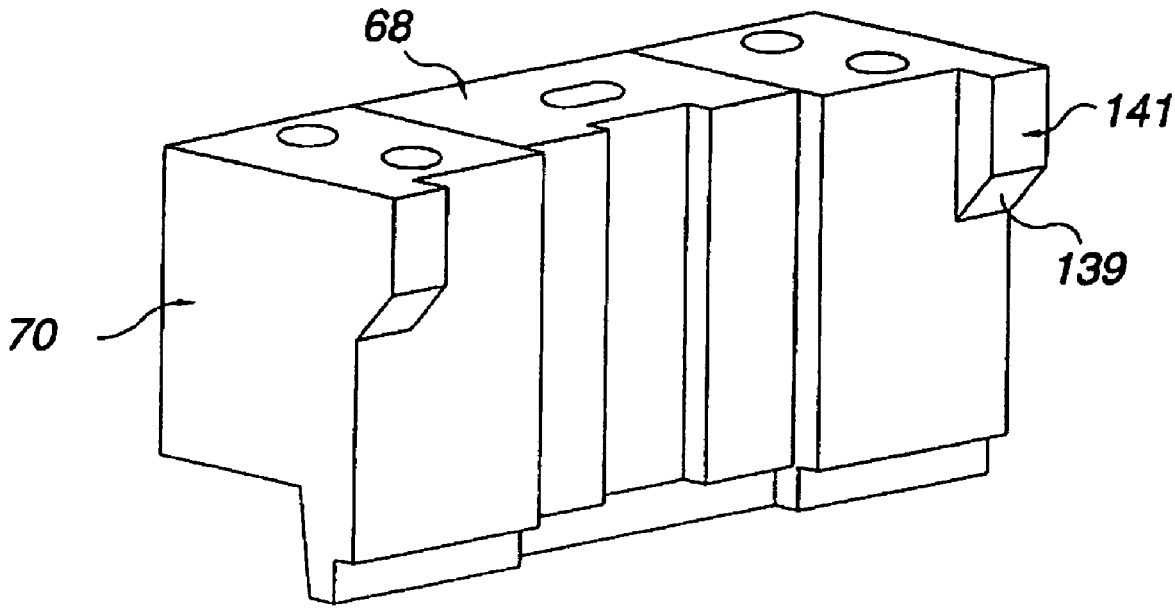
FIG. 7 is a perspective cross-sectional view of former and bending assemblies.
Figure 7B:
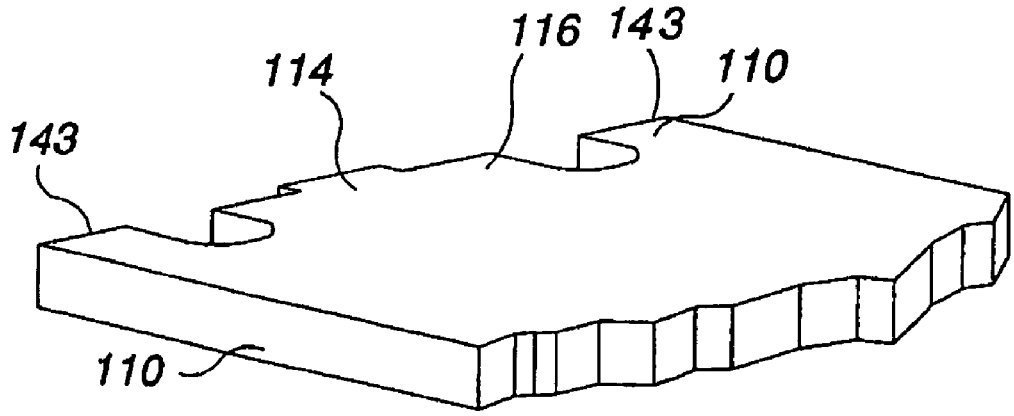
Figure 8:
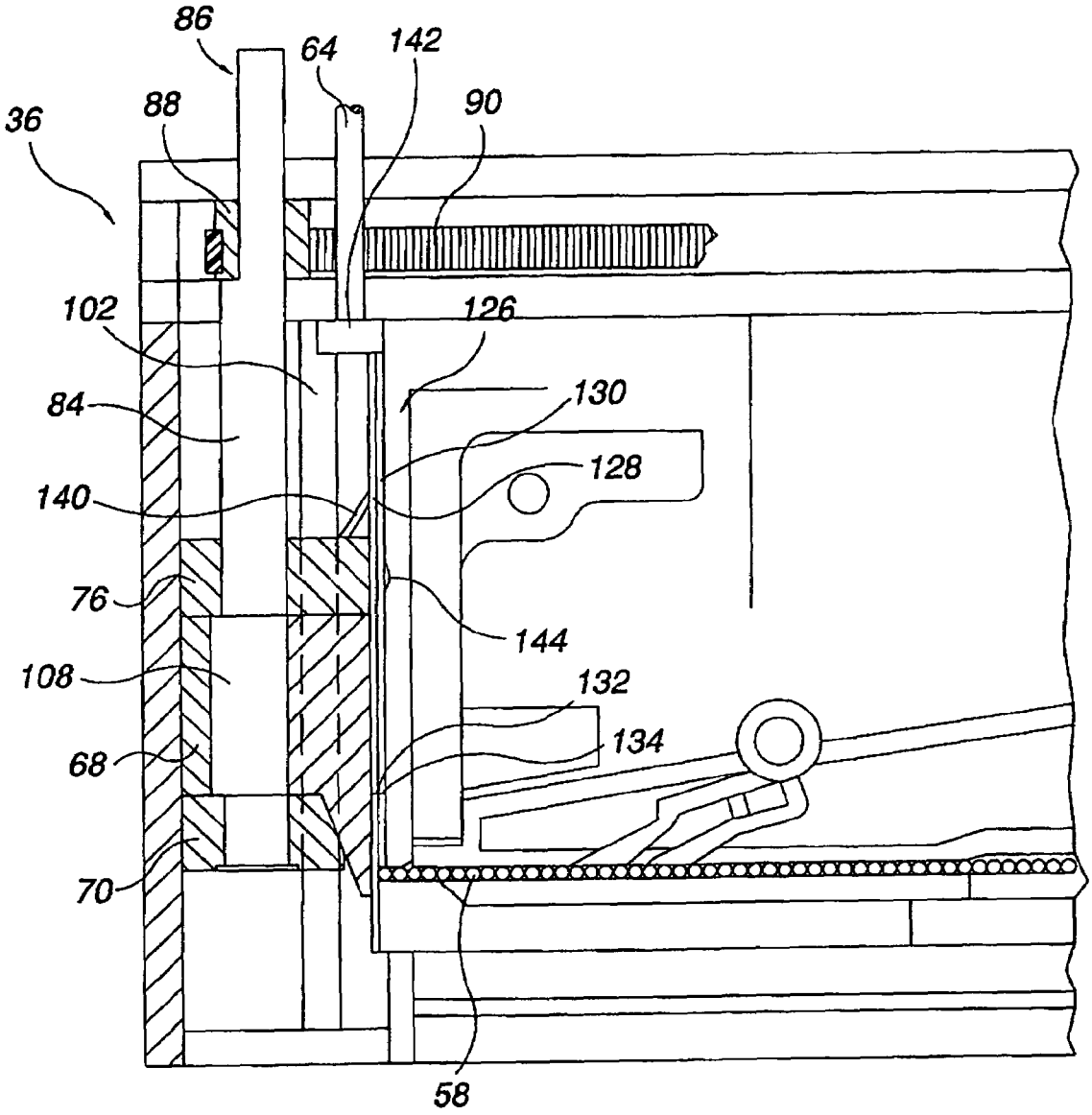
FIG. 8 is an enlarged view of the former/driver assemblies.

The stapler has a former assembly 65 and driver assembly 66, which together comprise a former/driver assembly or mechanism. Referring to FIG. 6, the former assembly preferably includes at least a small former portion 68 and a large former portion 70. The large former portion 70 has two side portions 72 and a base 74 connecting the side portions 72. As shown in FIGS. 6 and 7, the small former portion is disposed against the base 74 and between the side portions 72. As shown in FIG. 8, a coupling plate 76 is disposed above and against the side portions and the small former portion 68, and bolted to side portions 72 through threaded holes 78. The coupling plate 76 and the base 74 of the large former portion 70 couple the large and small former portions to move together substantially in the vertical direction. The small former portion 68, however, is slidably associated with the large former portion 70 for sliding in a fore and aft direction. References in this application to vertical, horizontal fore and rearward directions or the like are made for convenience, although different embodiments may be located in different positions.

The small former 68 has an oblong bore 80 extending vertically therethrough and leading to a circular bore 82 in the base 74 of the large former portion 70. The oblong bore 80 receives a configuration selector shaft 84 extending therethrough, and extending through bore 82 and a bore in the coupling plate 76 aligned therewith. At the upper end of the control shaft is a flattened surface 86 which is engaged within a gear 88, which in turn is driven by belt 90, wherein belt 90 is driven by stepper motor 93.

The small former portion 68 includes two small side portions 92 separated by space 94 at a recess 96. Below the side portions 92 is a blank limit notch 98 which prevents the band of staple blanks 58 from moving past a forming and driving position when they engage against the formers. Similarly, the large former portion 70 has blank limiting notches 100 disclosed beneath the side portions 72, also for positioning the front staple blank 58 at the proper position for forming and driving. Guide shafts 102 extend through bores 104 of the large former portion 70 and through bores aligned therewith in the coupling plate 76. These shafts 102 are secured at both their top and bottom for guiding vertical motion of the former assembly. The side portions 72 of the large former portion 70 are separated by a space 106, which is substantially equal to the width of the small former portion 68.

The former, driver assembly is shown in a configuration for forming and driving staples of a large crown size and a short leg. In this configuration eccentric portion 108 of shaft 84 locates the small former portion 68 rearwardly, to expose space 106 between the large side portions 72.

Figure 9:
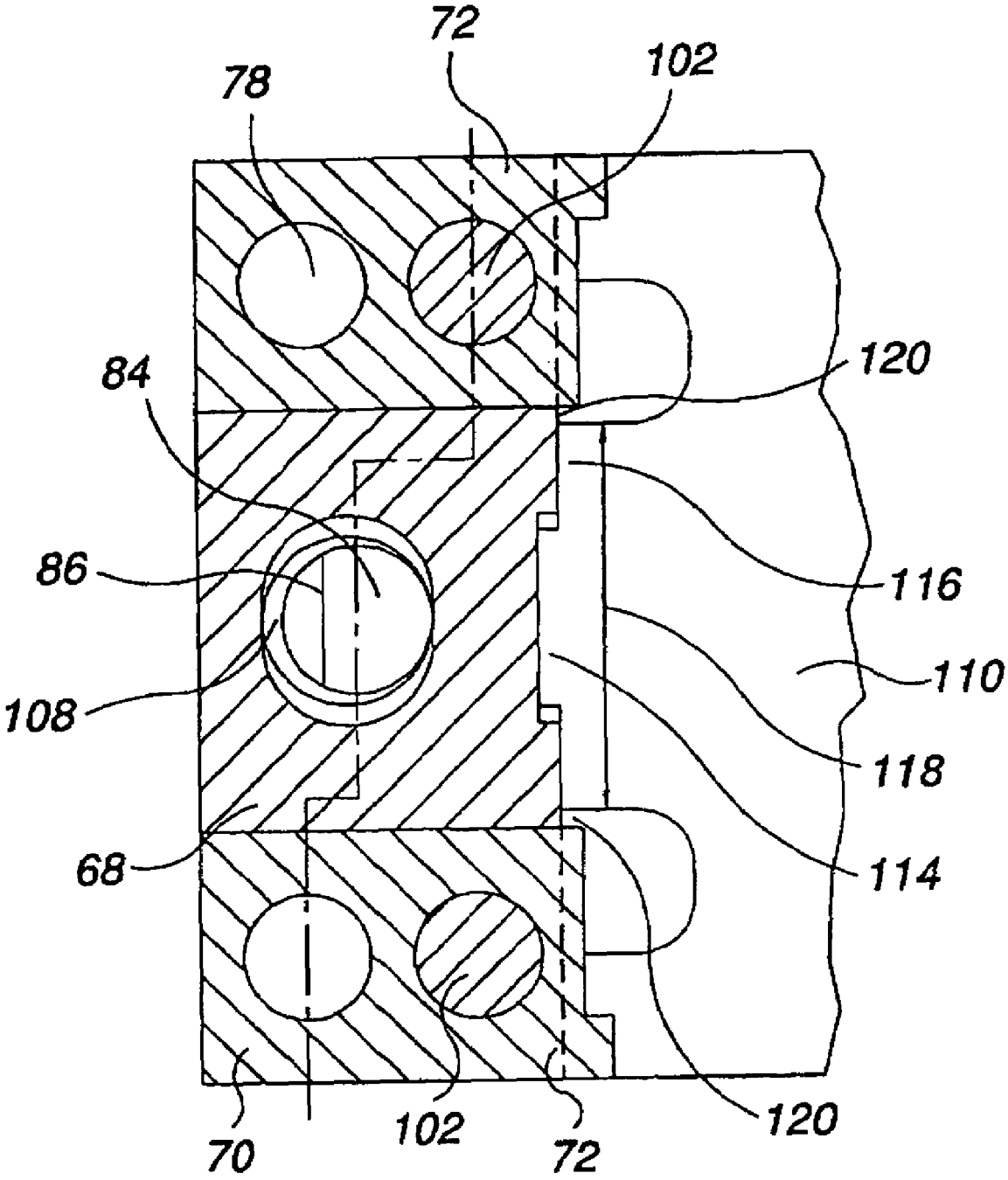
FIGS. 9 and 10 are cross-sectional top views of a portion of the former and bending assemblies in different configurations.

A bend plate assembly 110, is preferably constructed as a unitary piece, but may include separate moving portions. Referring to FIGS. 7 and 9, the bend plate 110 preferably includes a small bend portion 114 and a large bend portion 116, which are longitudinally adjacent each other. The leading edges of the bend plate 110 are resiliently biased against the small former portion 68. A width 118 of the large bend portion 116 is smaller than the space 106 by an amount sufficient to provide staple leg clearance spaces 120 between the lateral edges of the large bend portion 116 and the large side portions 72. In this configuration, the leading staple blank 58 is stopped for forward motion at the blank limiting notches 100 of the large side portions 72. A forward feed spring and mechanism 122 and an anti-retract member 124 are preferably provided and function in a manner as will be understood by those of ordinary skill in the art. A suitable mechanism is disclosed in U.S. Pat. No. 4,583,276, which is hereby incorporated by reference. Other advancing mechanisms are also suitable, such as a drive motor directly driving the band or driving other members associated with the band.

Figure 10:
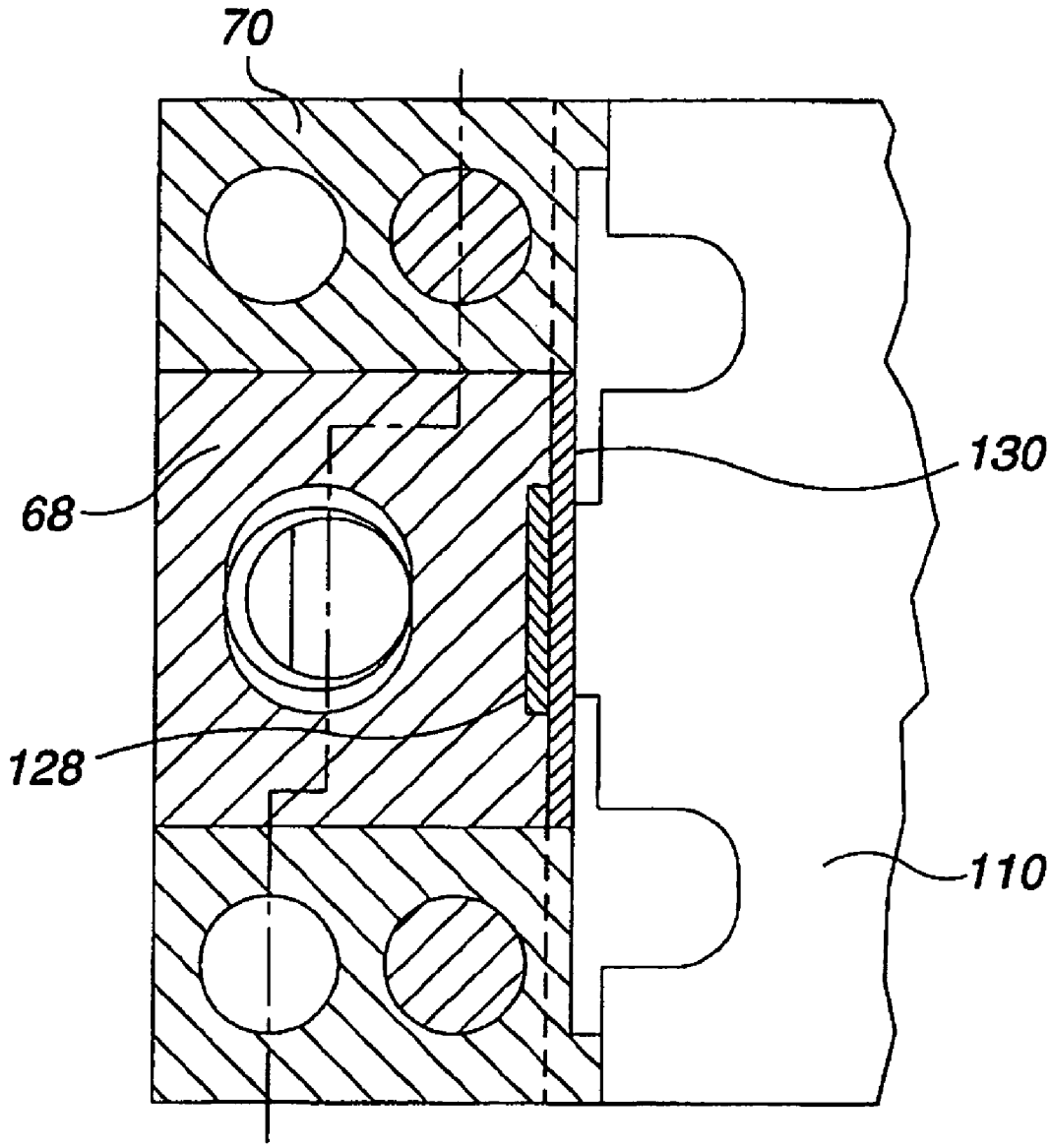
Figure 12:
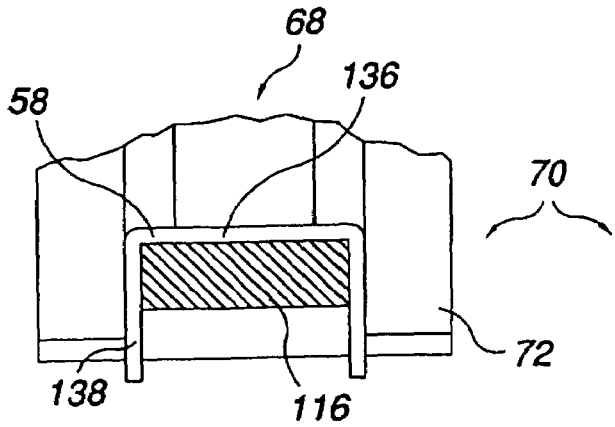
FIGS. 11 and 12 are longitudinal cross-sectional views of the forming process in a large crown configuration.

Referring to FIGS. 4, 8, and 10, a driver assembly 126 preferably includes a small driver blade 128, and a large driver blade 130. The small driver blade is received in the recess 96 of the small former portion 68 and has substantially the same width 94. The large driver blade 130 is preferably in contact with the small driver blade 128 and is disposed against the front surfaces, which face the bend plate assembly 110, of the small former portion 68. Both drivers preferably move longitudinally together with the small former portion 68. Each driver blade 128 and 130 has a driving surface 132 and 134. In the large crown configuration, the driving surface 134 of the large driver blade 130 is the operative driving surface, as it is aligned above the leading staple blank, which is disposed over the operative top bend surface of the bend plate 110, which is the top surface of the large bend portion 116. Also, in this configuration the operative former side portions are the side portions 72 of the large former portion 70, as these are also aligned above the leading staple blank 58. Thus the operative side portions are disposed laterally adjacent and on opposite sides of the operative top bend surface. The small side portions 92 and the small bend portion 114 are disposed out of the plane extending through the operative surfaces and the leading staple blank 58.

Figure 11:
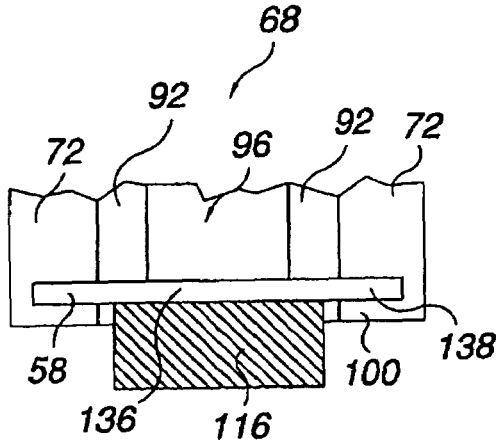

Referring to FIG. 11, the blank limiting notches 98 and 100 preferably extend further in the vertical direction than the diameter of the staple blank 58, more preferably between half and whole diameter beyond the blank 58 in a vertical direction. Generally staple blank cross-sections are oval, with a major axis measuring 0.022 inches and a minor axis measuring 0.018 inches. The most preferred additional vertical space of the blank limiting portions is between 0.01 and 0.015 inches. Large bend portion 116 is shown engaged with a crown portion 136 of the blank 58, and the operative side portions are shown engaged with yet unbent leg portions 138 of the blank 58. When the former assembly is forced down in relation to the bend plate 110, the operative side portions bend the legs down around the sides of the operative large bend portion 116. The small bend plate, being out of plane with the staple blank 58, preferably does not bend the blank 58. The resulting front crown width is less than or equal to the space 106 and more than or equal to the width 118. The formed legs of the staple 58 are disposed in clearances or spaces 120.

Preferably the large former portion 70 also includes ramps 139 of cam portions 141, which are aligned for movement along a path to cam the cam portions 143 of the bend plate 110. When the former assembly passes the vertical point in its travel after which the forming of the legs of the staple blank 58 is complete, the cam portions 141 of the former assembly displace the bend plate 110 out of the driving path of the driver assembly so that the formed staple can be driven into the stack 62. The cam portions may alternatively be located on another element that moves with the former/driver assembly, or the bend plate may simply be moved independently, such as by another motor, a solenoid or other means.

Figure 13:
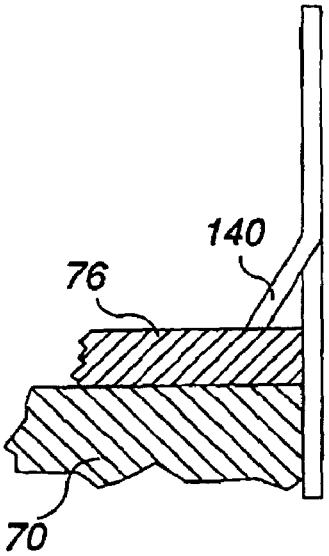
FIG. 13 is a side view of a portion of the former/driver assembly.
Figure 15:
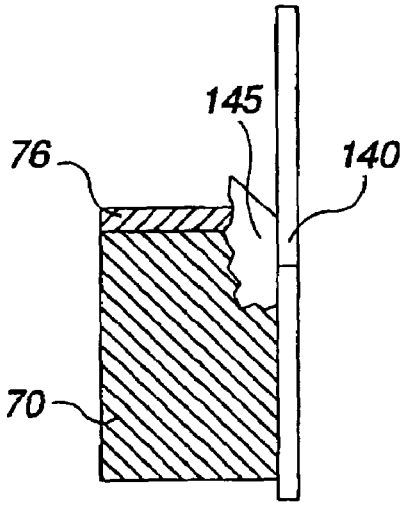
FIG. 15 is a side view thereof after the forming step is complete.
Figure 14:
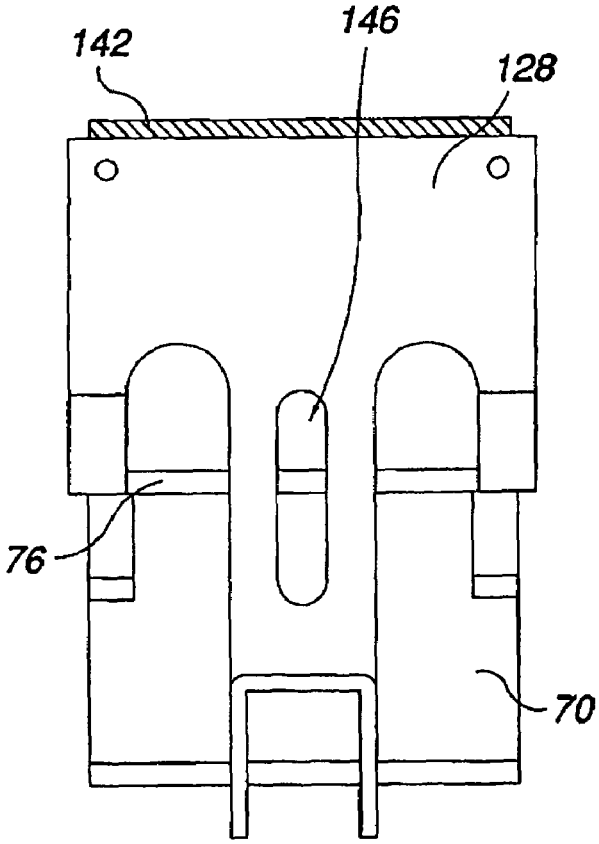
FIG. 14 is a longitudinal view thereof.

Referring to FIGS. 13 and 14, the small driver blade includes legs 140 drivingly engaged against the top of the coupling plate 76. The driver actuator 64, as seen in FIG. 8, has a preferably flat plunger portion 142, which is preferably fixed to the top of the small driver blade. In a large crown configuration, the plunger 142, is also aligned with the large driver blade 130. Thus, when the drive control unit 30 is moved downwardly against the driver actuator 64, the plunger 142 biases both drive blades 128 and 130 downwardly. Legs 140 bias the former assembly downwardly, causing the former assembly to bend the staple legs 58 as described. Once the driver actuator 64, the blades 128 and 130, and the former assembly have been moved vertically to a predetermined location, at a sufficient height such that the legs of the staple have already been formed, the legs 140 of the small blade 128 are cammed back, in a direction towards the blank cartridge 56 by ramps 145, which are preferably secured to the housing, preferably beyond the former assembly, to release the former assembly and allow the driver assembly to continue moving downward separate from the former assembly, as shown in FIG. 15. As shown in FIG. 5, the formed staple 58 is separated from the band of staples and driven through the stack 62. As the bull gear 42 continues to rotate, and lifts the driver actuator 64, button 144, which is fixed to the driver assembly, preferably to the coupling plate 76 and is received in slot 146 of the small blade 128, contacts the edge of the slot 146 and lifts the former assembly back up to the starting position.

Figure 18:
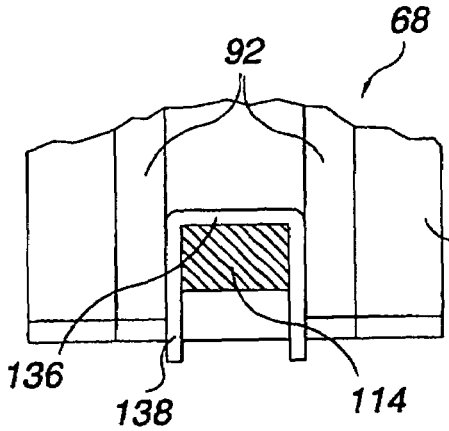
FIGS. 17 and 18 are longitudinal cross-sectional views of the forming process in the small crown configuration.
Figure 17:
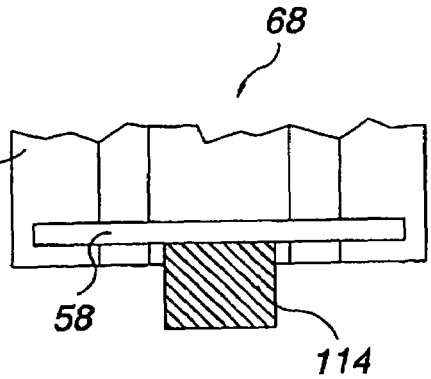
Figure 16:
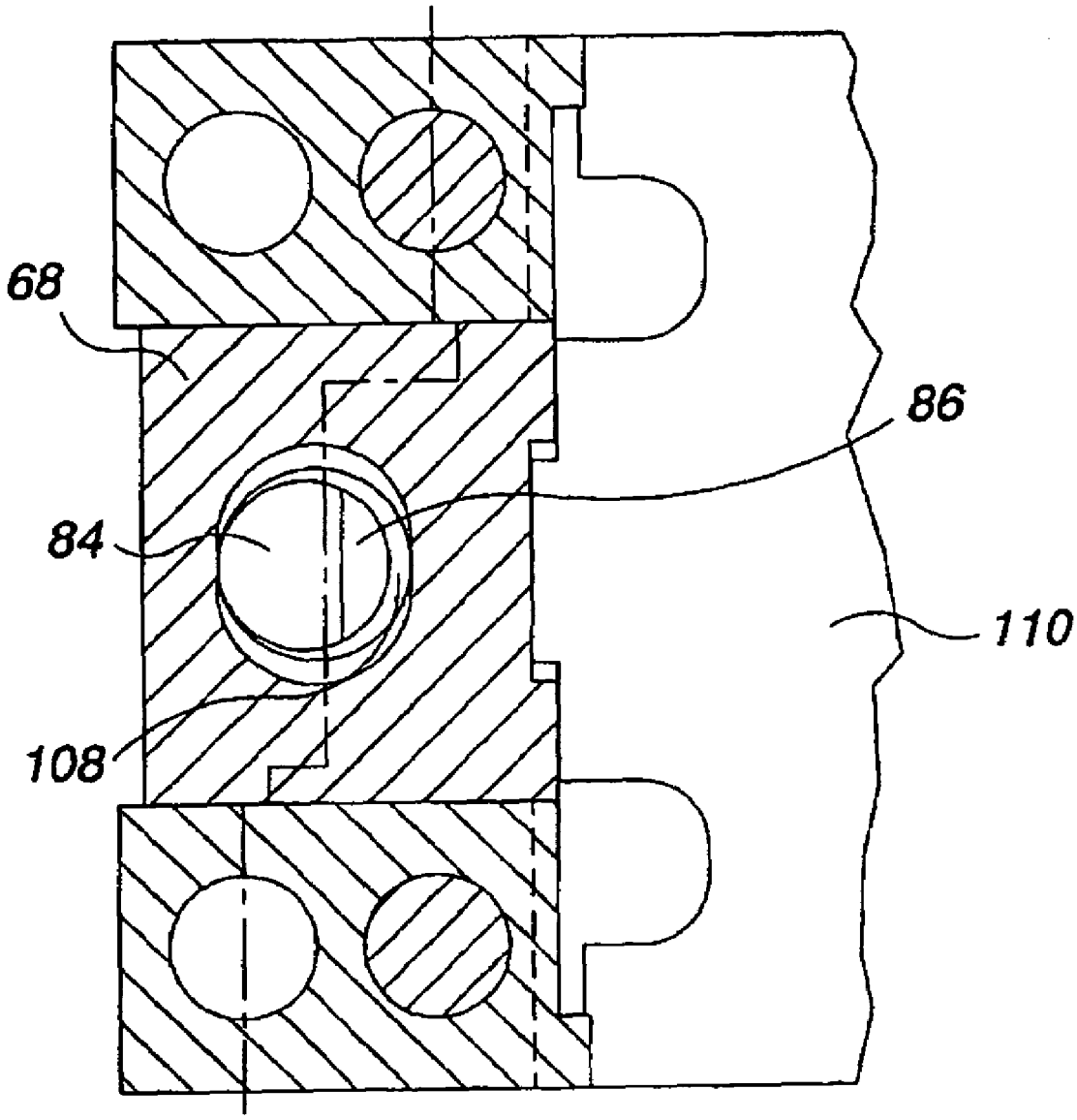
FIG. 16 is a cross-sectional top view of a portion of the former and bending assemblies in a small crown configuration.

A second stapling configuration, corresponding to a smaller crown size and longer staple legs, is selectable by operating the stepper motor to rotate the control shaft 84 preferably by about 180 degrees. As shown in FIG. 16, eccentric portion 108 displaces the small former portion 68 towards the bend plate 110, displacing the bend plate. The front edges of both former portions 68 and 70, are preferably now flush. The blank limiting notches 98 and 100 are now aligned such that the leading staple blank 58 is disposed within the notch and against both large and small former portions 68 and 70. As shown in FIG. 17 and 18, the operative top surface of the bend plate 110 is the small bend portion 114, and the operative side portions are the small side portions 92. As the formers move down with respect to the bend plate 110, the small side portions 92 engage and bend the leg portions 138 of the staple blank 58 between the bend plate 110 and the side portions 92. As seen from the drawings, the crown width is smaller when the staple is in this configuration, and the leg length is larger. This configuration is better suited for stapling stacks 62 of a larger height than the stacks for which the stapler is best suited in the large crown-configuration.

Figure 19:
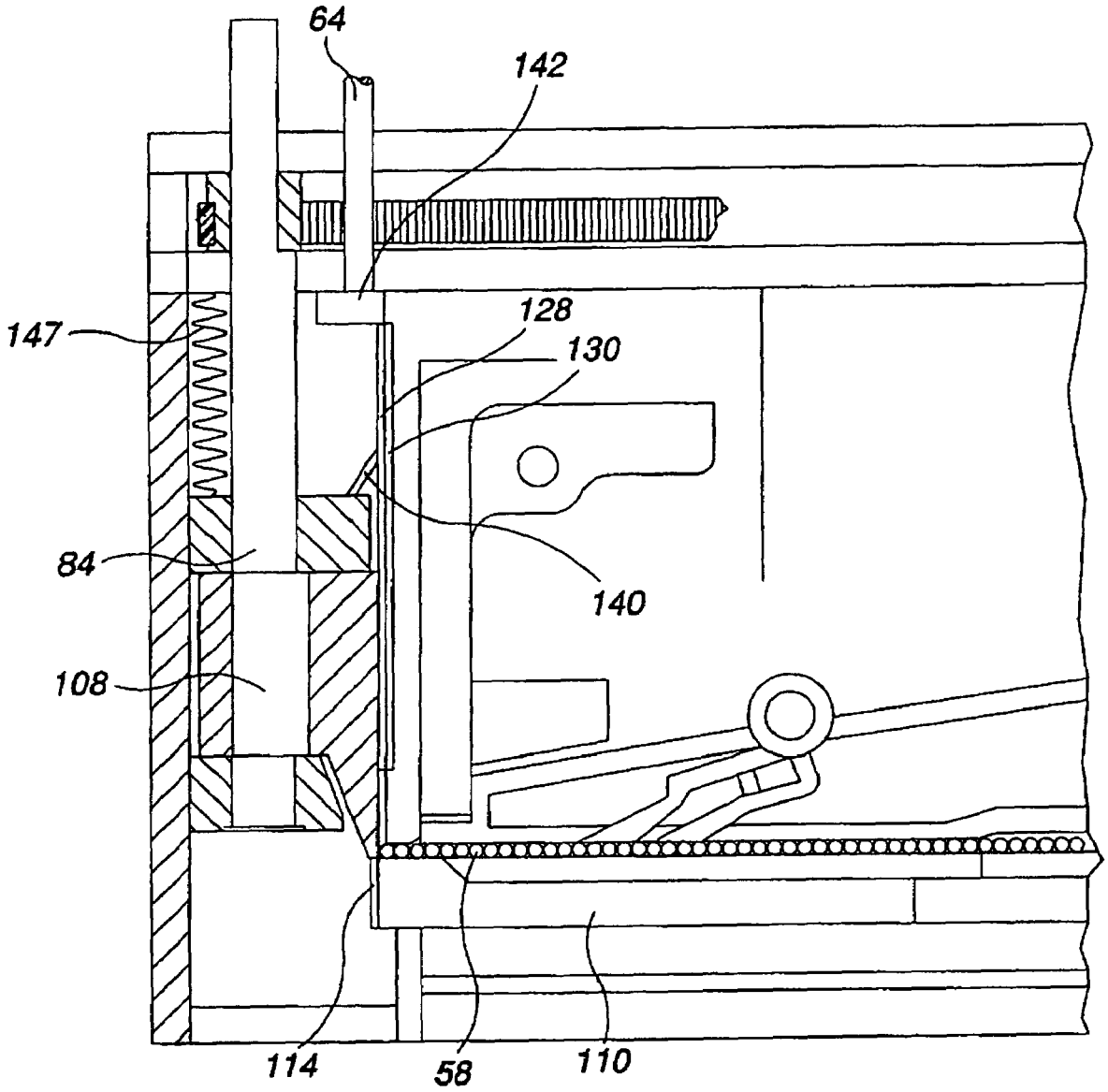
FIG. 19 is an enlarged view of the former/driver assemblies in the small crown configuration.

Referring to FIG. 19, the large driver blade, which is now disposed over the second foremost staple blank 58, is no longer aligned with the plunger 142. Thus, when the plunger biases the small driving blade 128 towards the staple blanks 58, the plunger 142 bypasses the large driver blade 130, which preferably remains inoperative during the forming and driving strokes of the stapler. Also shown in FIG. 19 is a spring 147, which may be employed to raise the forming assembly back to the starting position after the forming stroke is complete.

Preferably, the stapler includes a thickness sensor, as known in the art, positioned near the stapling zone 150 to determine the height of the stack. If the height of the stack is sensed to be below a predetermined amount, such as below 50 pages, then electronic or electric circuitry preferably operates stepping motor to rotate the control shaft to configure the stapler in the large crown configuration. If the sensor detects a stack height above the predetermined amount, then the stepping motor preferably positions the control shaft to configure the staple in the small crown configuration. U.S. Pat. No. 4,134,672 shows an example of a stack height sensor and electronic control unit. In other embodiments, the shaft 84 may be manually or otherwise rotatable with or without electronics and positionable to select a stack height. Other mechanisms for reconfiguring the stapler may also be employed. For example, the formers and drivers may together or independently be moved by solenoids or separate motors, or by any other actuating mechanism, including manual adjustments made by an operator, to suitably configure the stapler. Additionally, more than two former portions may be employed to form staples to more than two preselected configurations. Also, in an alternative embodiment, the plunger 142 may be associated with another cam on the control shaft 84 to amplify the longitudinal movement thereof.

Figure 20:
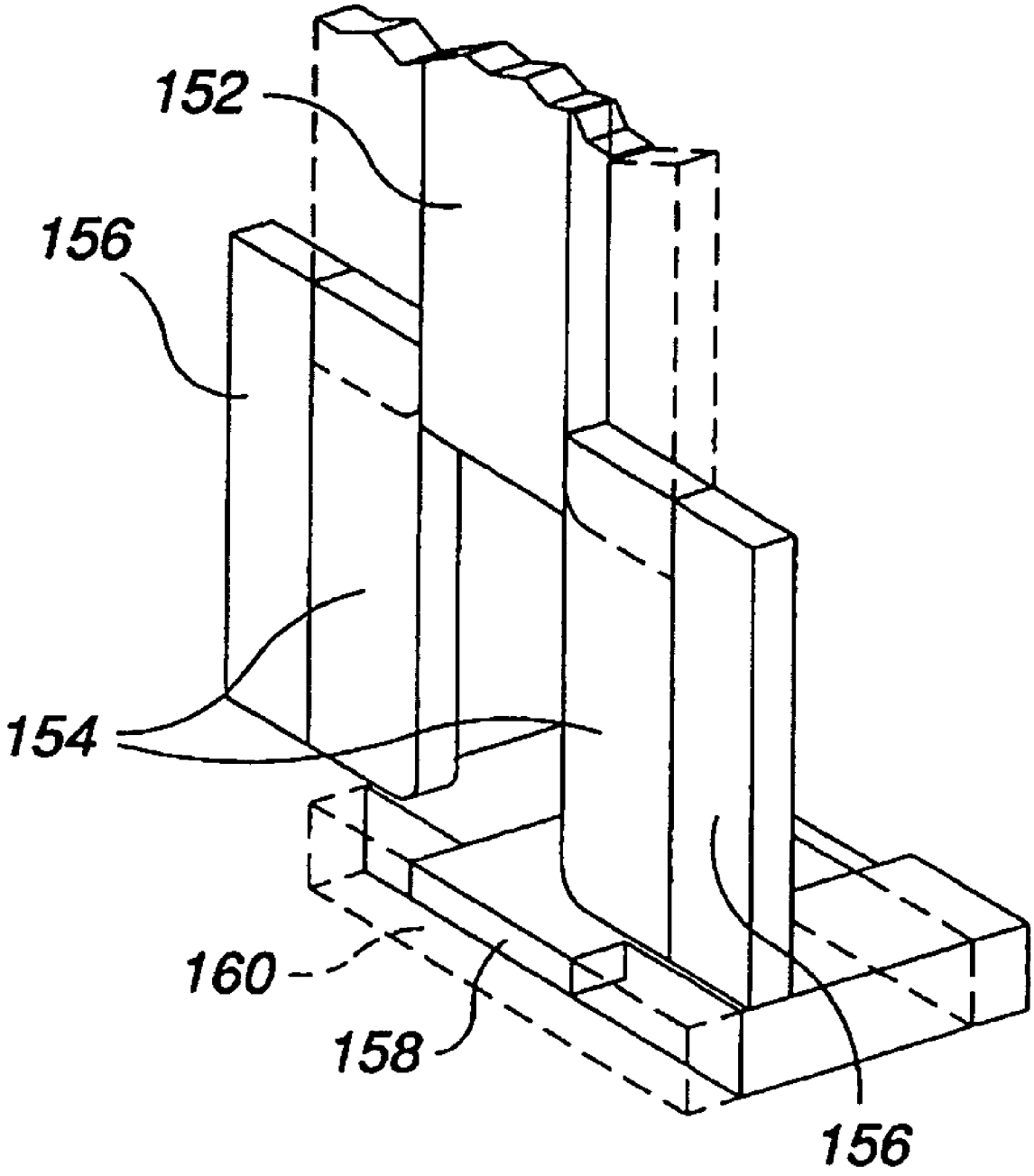
FIG. 20 is a perspective view of an alternative embodiment of the former/driver assembly.

An alternative embodiment of the former/driver mechanism is shown in FIG. 20. This embodiment is also configured for forming staples into one of two crown sizes. The stapler includes central and inside blades 152 and 154 and outside blades 156.

The bend plate assembly includes a small width portion 158 and a large width portion 160. Preferably the large width portion 160 is slidable longitudinally with respect to the small portion 158, but the small and large portions 158 and 160 may be fixed together similar to the bend plate 110 in the first preferred embodiment described.

The positions of the blades 152, 154, and 156 in the small crown configuration are shown in solid lines, as are the positions of the bend plate portions 158 and 160. In this configuration, the former assembly includes plates 156 and 154, which move together downwardly with respect to the operative small portion 158 of the bend plate, on which lies the staple blank (not shown). Once the blank is formed with the staple legs bent between the blades 154 and the small bend portion 158, blade 152, which functions as a driver, descends upon the formed staple as the bend plate is moved longitudinally out of the path of the blade 152 to drive the staple through a stack. In this configuration of the former/driver mechanism, the driver assembly comprises the blade 152.

The preferred starting positions of the blades in the large crown configuration are shown in dashed lines in FIG. 20. The large bend portion 160 is positioned beneath the blades in this configuration, and the driver assembly comprises blades 152 and 154 which begin in an elevated position with respect to the outer blades 156. The former assembly in this configuration now comprises only blades 156, which descend laterally adjacent the large bend portion 160 to bend the legs at a different location along the bend plate, forming a finished staple with a larger crown size. The individual blades may be moved separately such as by solenoids, a linkage mechanism, motors with lead screws, or by any other suitable mechanism, and the same is the case for the bend plate assembly. Also, the blades shown can be made with other shapes that are not necessarily flat, and can include additional blades or pairs of blades for forming staples with additional crown sizes.

Figure 21:
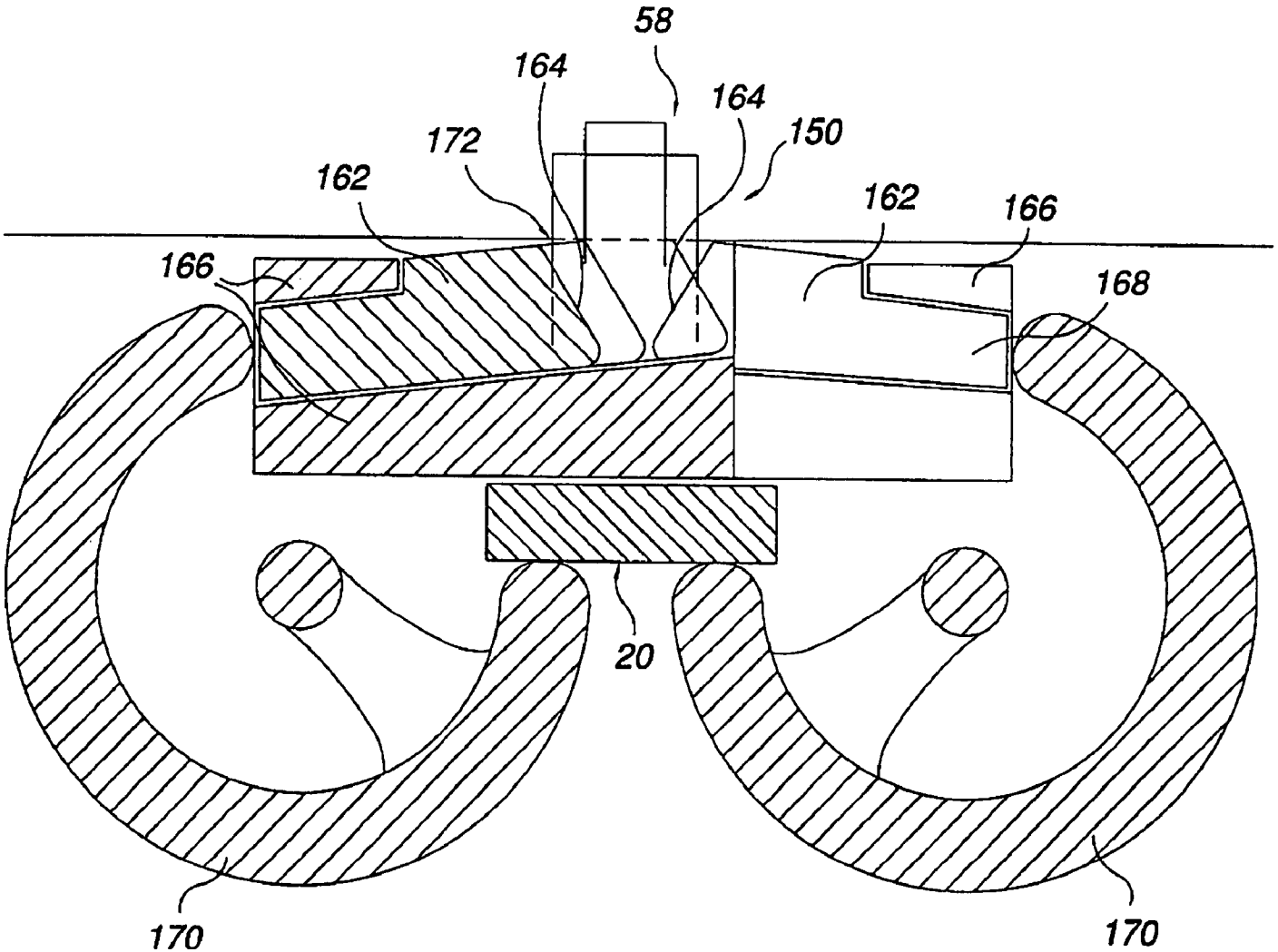
FIG. 21 is a front cross-sectional view of a preferred embodiment of a clinching mechanism of the stapler constructed according to the present invention.

Referring to FIG. 21, the preferred clinching mechanism includes clinching members 162 with clinching surfaces 164. The clinching surfaces 164 are preferably disposed at an angle to the vertical, and face the stapling zone. The clinching members 162 are preferably movable along a clinching path that intersects the position in which the staple legs 138 extend through the stack to be stapled, regardless of the crown size. The clinching surfaces 164 are spaced laterally at least by the maximum crown width of a staple for which the stapler is configured to employ.

The clinching members are preferably mounted in housings 166, which include a passage configured to direct the clinching member 162 along the clinching path. Most preferably each clinching member 162 includes a guided portion 168 which is guided by and received within the housing 166. The preferred clinching path is linear, as shown in FIG. 21, but other paths may also be employed. Preferably the clinching path is selected such that regardless of the crown size or separation of the staple legs, the clinching surfaces 164 contact the legs initially substantially at a same contact angle, or an angle within a preferred range.

In this embodiment, the clinching members 162 are activated when cam pins 26 cammingly engage and displace cam lobes 24 to rotate or otherwise move the kicker plate 20 downwardly. As plate 20 engages table linkages 170, which are preferably pivotally associated with frame 12, linkages 170 are rotated against the clinching members 162 to displace the clinching member 162 along the clinching path, thereby clinching the bottom portions of the staple legs that protrude into an anvil area 172 beneath the stack. Other means of actuating the clinching members, such as solenoids, or any of the parts of the stapler may also be actuated by a controlling electronic or electric circuitry. Additionally the clinching members 162 may be linked to the linkages 170, and linkages 170 may be linked to the plate 20, such that when the kicker plate 20 is moved back in the upwards direction, it pulls the linkage 170 and the clinching members 162 back to their starting positions in order to receive the legs of the next staple to be stapled. In this embodiment the clinching members 162 are thus movable in a clinching direction along the clinching path towards the staple legs for bending the legs generally orthogonally to the clinching direction.

Figure 22:
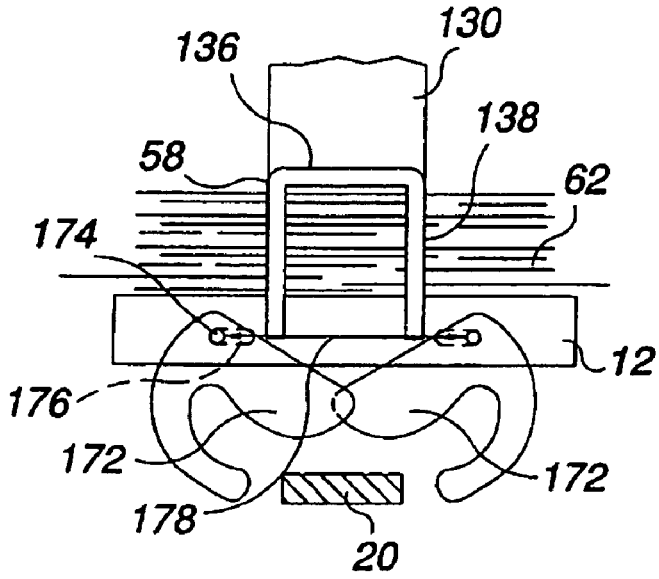
FIGS. 22 and 23 are partial front views of an alternative embodiment of the clinching mechanism in large and small crown configurations, respectively.
Figure 23:
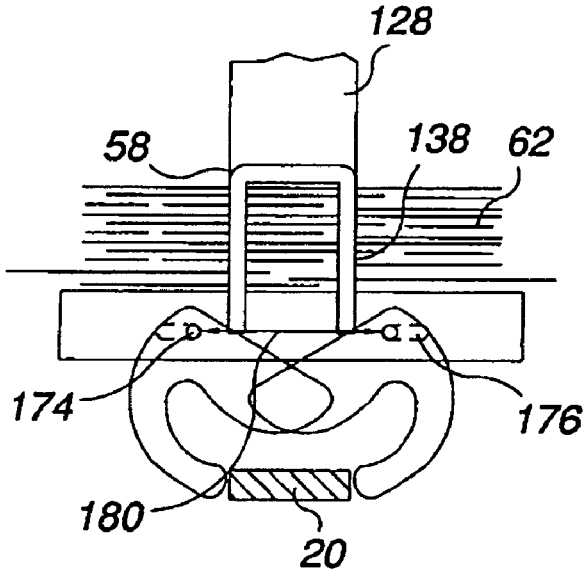
Figure 24:
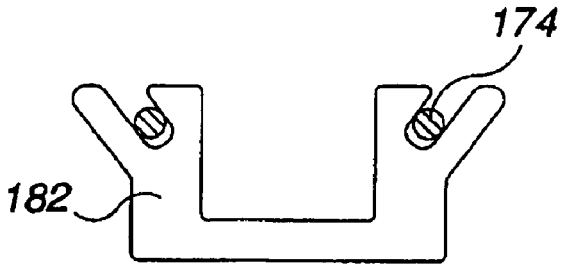
FIG. 24 is a partial front view of a pivot-positioning mechanism thereof.

In the embodiment of the clinching mechanism shown in FIGS. 22–24, the clinching members comprise clinching wings 172 which are actuatable by the kicker plate 20. The clinching wings 172 are preferably mounted on pivots 174 which are slidably received in slots 176 of a portion of the stapler, such as the frame 12.

In FIG. 22, the clinching wings 172 are positioned with pivots 174 and corresponding pivots points spaced by a wide distance 178. Thus the legs of a staple having a large crown 136 can be contacted at the selected and most effective angle of initial contact as the clinching wings pivot against the legs 138. In FIG. 23, the pivots 174 have been displaced towards each other such that they are separated by a distance 180, which is smaller than distance 178, to initially contact the longer and closer legs 138 of a staple with a smaller crown size at substantially the same angle as illustrated in FIG. 22, but within an acceptable angular range therefrom.

Referring to FIG. 24, pivot control member 182 is preferably provided, and is movable in a vertical direction in order to position the pivots 174 laterally within the slots 176. In the embodiment of FIGS. 22 and 23, the clinching path is generally arcuate with respect to the stapling zone and the staple legs 138. The path is thus shiftable by shifting the pivot points.

Figure 25:
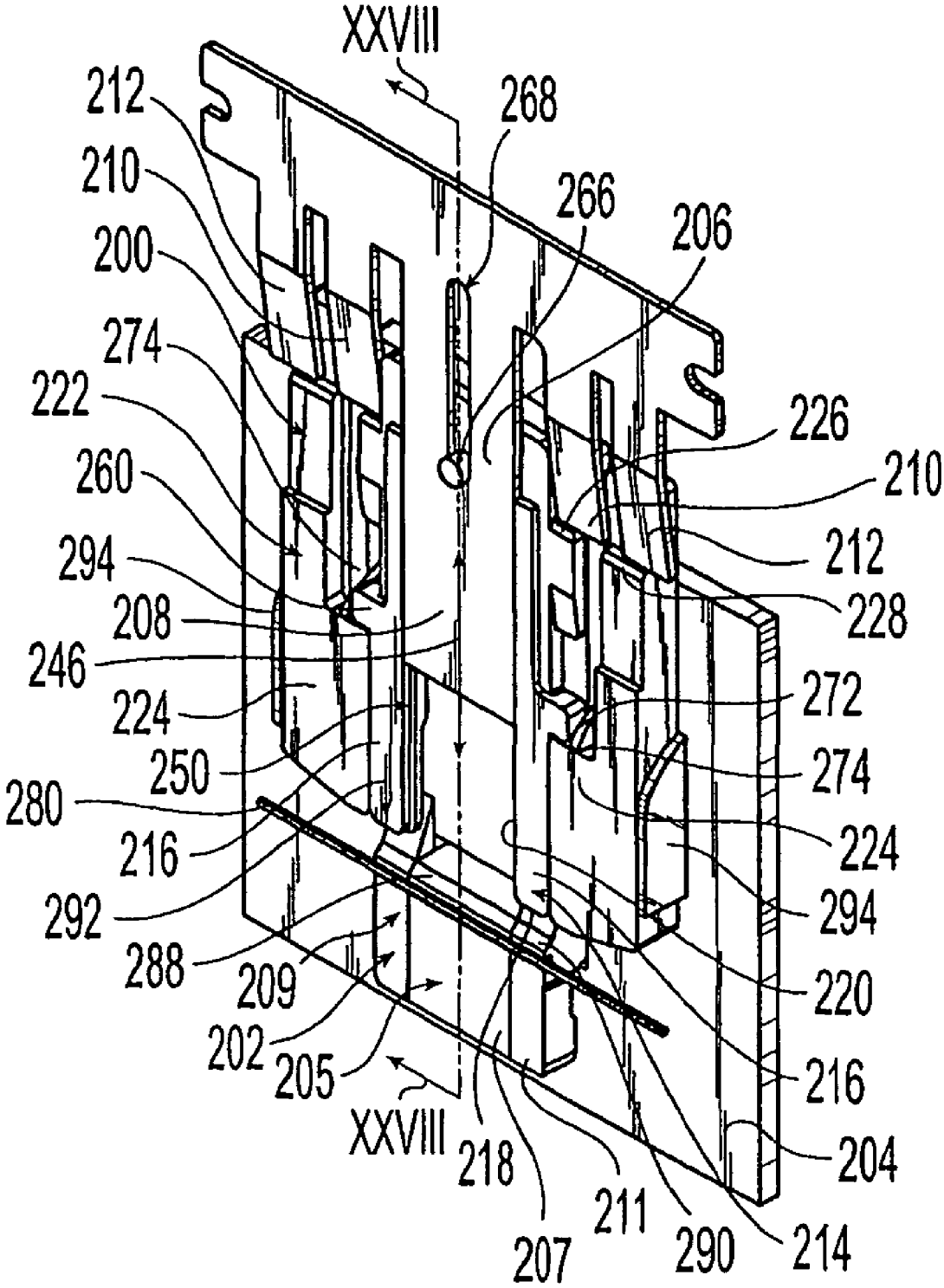
FIG. 25 is a perspective view of a driver/former assembly of an alternative embodiment of a stapler constructed according to the present invention in a small crown configuration and a home position.

In the embodiment of FIG. 25, driver/former assembly 200 and bending assembly 202 are mounted to a faceplate 204. The driver/former assembly 200 includes a small driver 206, which preferably comprises a driver blade 208, but may alternatively comprise a different structure suitable to drive formed staples. Preferably, the driver blade 208 is of steel, such as spring steel, and of integral, unitary construction with small and large coupling members 210, 212, which preferably comprise fingers that are resiliently angled towards the faceplate 204. The fingers of the small coupling member 210 are preferably disposed between the fingers of the large coupling member 212.

A small former/driver 214 includes small side staple-engaging portions 216, which are disposed on each lateral side of the driver blade 208. A large former 222 has large side staple-engaging portions 224 disposed laterally outside of the small side portions 216 with respect to the driver blade 208.

Figure 26:
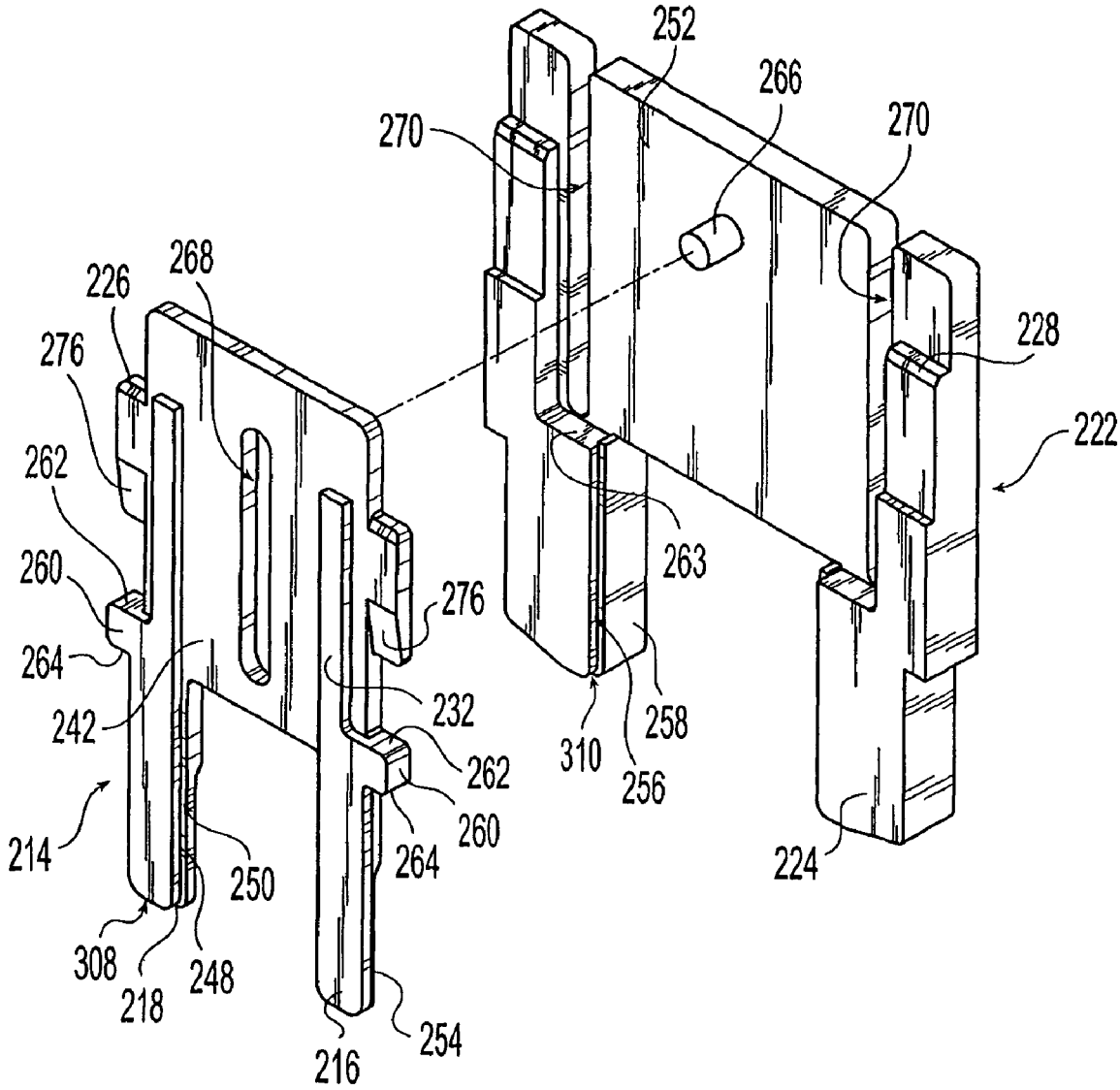
FIG. 26 is an exploded view of a former thereof.
Figure 31:
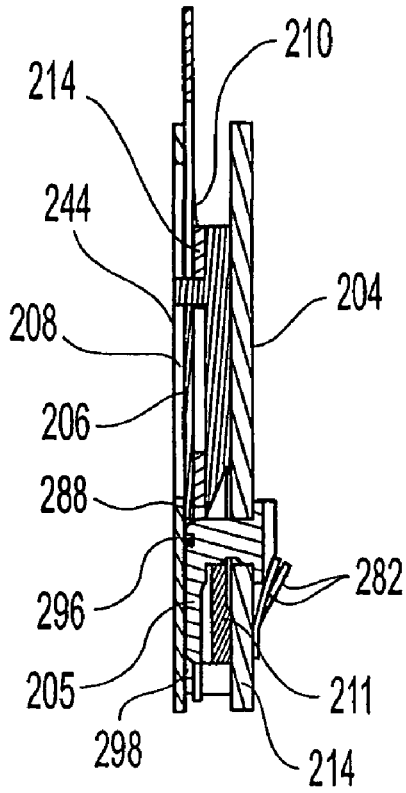
FIG. 31 is a cross-sectional view thereof along line XXXI–XXX1.

As shown in FIG. 26, the small former/driver includes protruding guides 232, which protrude from small connecting member 242 that connects the side portions 216. The protruding guides 232 and the small connecting member 242, in conjunction with an additional backplate 244, shown for example in FIG. 31, are configured to guide driver blade 208 as it moves along a longitudinal driving path 246. The small side portions 216 have inwardly extending small guide protrusions 248, defining small guide tracks 250, which together with the backplate 244 are configured for guiding the driver blade 208 along the driving path 246, and also for guiding legs of a formed, driven staple into a workpiece and against an anvil.

The large former 222 of this embodiment similarly has a large connecting portion 252, which has a surface disposed laterally forward of the large side portions 224 and is disposed and configured to guide the small connecting portion 242 of the small former/driver 214, preferably parallel to the driving path 246. Lateral extensions 254 of the small side portions 216 extend outwardly to be received in large guide tracks 256, which are formed between walls of the large side portions 224 and inwardly extending large guide protrusions 258. The large guide tracks 256 and the backplate 244, together with lateral extensions 254, also guide the small former/driver 214 during its operative motion during the forming and driving of staples.

Both the small former/driver 214 and the large former 222 of this embodiment have small and large first actuation portions 226, 228, respectively, which preferably include steps and are drivingly engaged by the fingers of the small and large coupling members 210, 212, respectively, in the small-crown configuration shown. In alternative embodiments, the actuation steps may be replaced with other surfaces of members that can interface or be actuated by the driver 206. The small former/driver 214 additionally has laterally extending engagement members 260 with top surfaces 262, which comprise second actuation portions, configured to drivably engage the fingers of the small coupling member 210 of the driver 206. The engagement members 260 also have bottom surfaces 264, which are positioned to engage upwardly facing lifting surfaces 263 of the large former 222 to be lifted by the large former 222 when the large former 222 is raised. Additionally, a lifting nub 266 preferably extends back from the large connecting portion 252 and is received in vertical slot 268 of the small former/driver 214 and in vertical slot 270 in the driver 206.

The large former 222 also defines openings 270, which in this embodiment comprise slots. A configuration-setting member 272, in this embodiment comprising configuration ramps 274, which sets the configuration of the stapler to form and drive staples of small or large crown sizes. The configuration ramps 274 are received through the openings 270 and extend rearwardly sufficiently to cam the fingers of the small engagement member out of driving association with the small first actuation portions 226 to disconnect the driver 206 from the small former/driver 214. As such, the driver 206 can be driven along the driving path 246 over a predetermined distance, without driving the small former/driver 214 until the small first actuation portions 226 reengage with engagement members of the small former/driver 214 to continue to drive the small former/driver 214. The small former/driver 214 also includes downward facing ramps 276 with a slope oriented to allow the small coupling-member 210 fingers to slide over the small former/driver 214 when these fingers are moved from below the downward facing ramps 276 in an upward direction, so that the small former/driver 214 and the driver 206 remain disengaged.

The faceplate 204 has ramps 294 that are preferably fixed and disposed adjacent the large former 222. Ramps 294 are associated with the fingers of the large coupling member 212 to disengage them from the large former 222, allowing the driver 206 to continue to move along the driving path 246 without moving the large former 222 any further once the fingers are disengaged.

Figure 27:
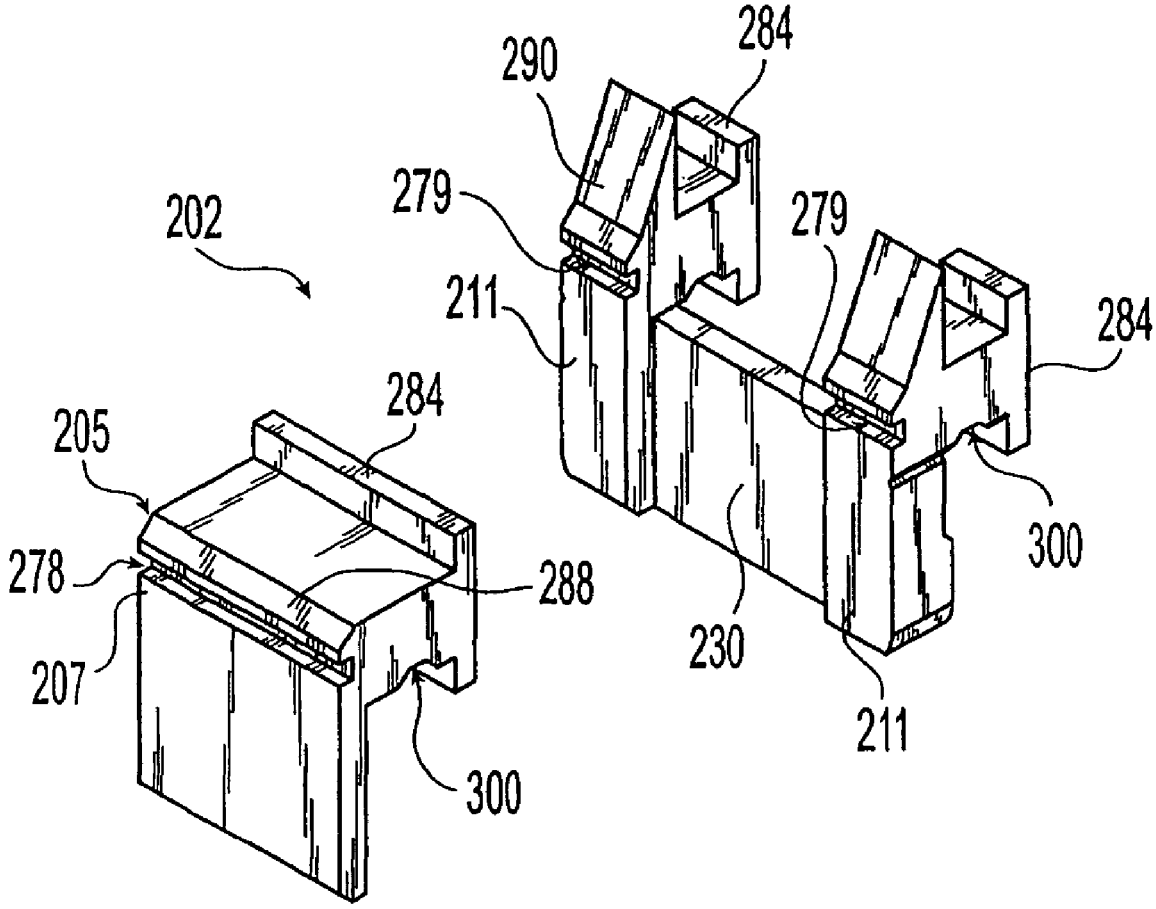
FIG. 27 is an exploded view of bending blocks of the driver/former assembly of this embodiment.

The bending assembly 202 is disposed below the driver/former assembly 200. The bending assembly 202 of this embodiment includes a small bending portion 205 that includes a small bending block 207, and a large bending portion 209 that includes large bending blocks 211, with the small bending block 207 disposed laterally between the large bending blocks 211. The large bending blocks 211 are connected by a block portion 230 that extends behind the small bending block 207, adjacent the face plate 204, as shown in FIG. 27.

The preferred small and large bending blocks 207, 211 define crown recesses 278, 279 extending horizontally and preferably generally perpendicularly to the driving path 246, in the bending position shown. The crown recesses 278, 279 are preferably dimensioned and configured to receive and locate a staple blank or pin 280 in a forming position, in association with the formers for forming the pin 280 to the desired crown size. The small and large crown recesses 278, 279 are aligned in the embodiment shown.

Figure 28:
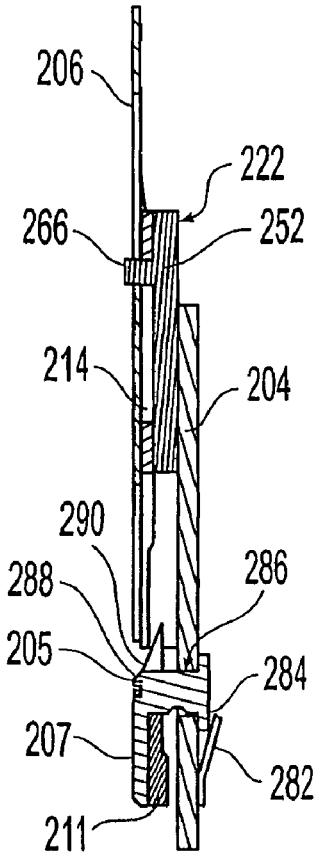
FIG. 28 is a cross-sectional view along line XXVIII—XXVIII of FIG. 25.
Figure 29:
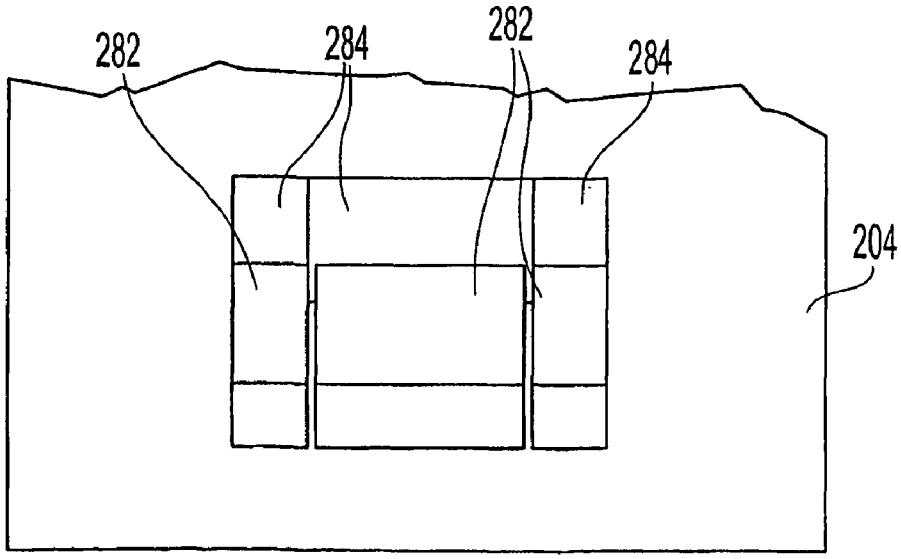
FIG. 29 is a front view of the driver/former assembly.

As shown in FIGS. 28 and 29, the bending blocks 207, 211 are resiliently biased in a rearward direction, such as by leaf springs 282, although other spring types, including wire springs, or other biasing members can be used. Springs 282 are attached to the faceplate 204 and are biased against end portions 284 of the bending blocks 207, 211. The bending blocks 207, 211 extend through the openings 286 through the faceplate 204. End portions 284 are preferably larger than openings 286 and are configured to position the bending blocks 207, 211 in the bending position.

Above the crown recesses 278, 279, the bending blocks 207, 211 include upward facing ramps 288, 290. In the bending position, ramp 288 of the small bending block 207 is positioned beneath the driver blade 208 and is associated therewith to be cammed and displaced out of the driving path 246 by the blade 208, preferably in a forward direction toward the faceplate 204. Ramps 290 of the large bending portion 209 are disposed under the small side portions 216 of the small former/driver 214 and are associated therewith to also be cammed and displaced out of the forming/driving path 292 by the small former/driver 214, preferably in a forward direction toward the faceplate 204. The ramps 290 of the large bending block 211 are preferably longer and reach a height above the ramps 288 of the small former/driver 214.

Figure 30:
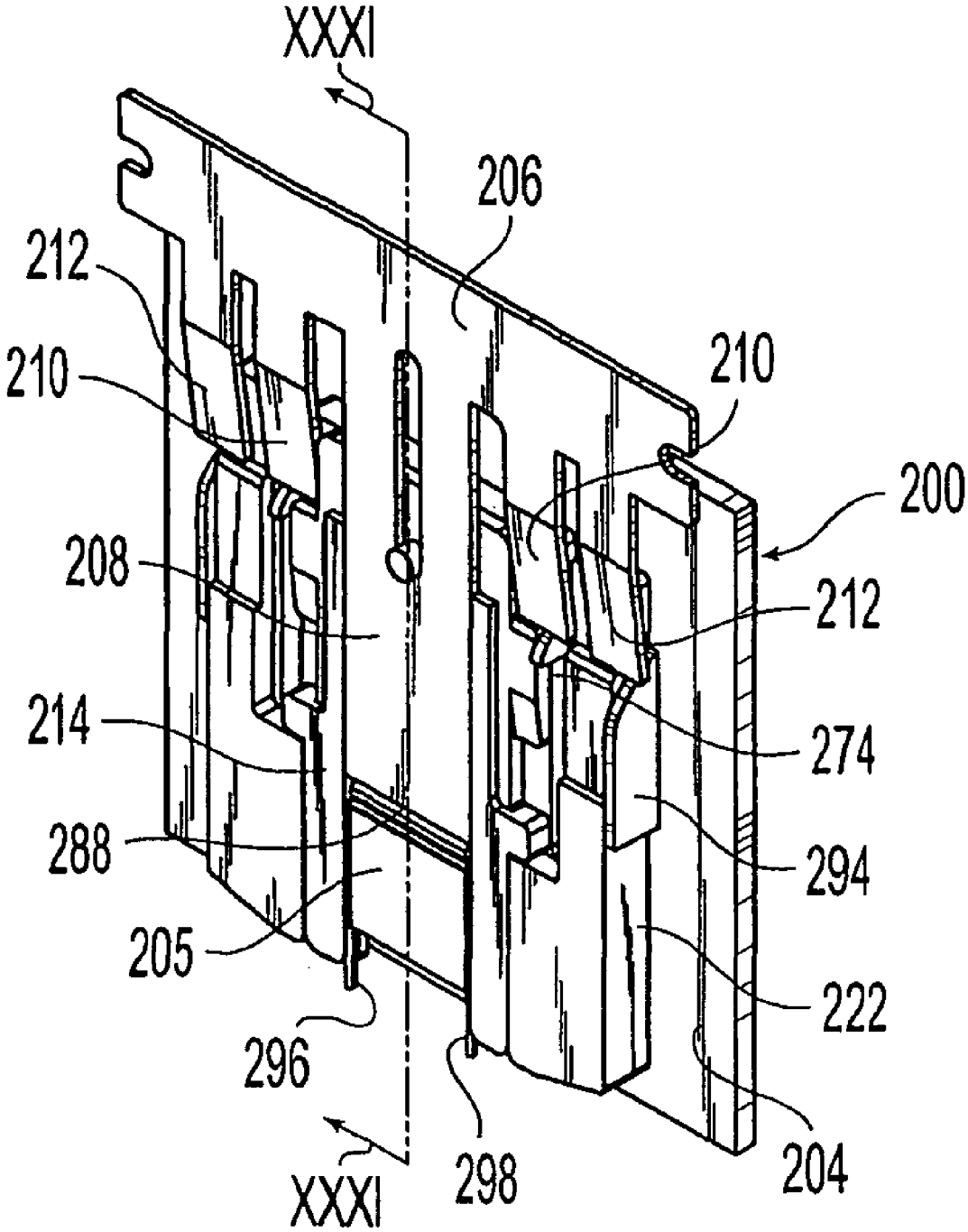
FIG. 30 is a perspective view thereof in a bending position.

Referring to FIGS. 30 and 31, as the driver 206 is driven by an actuation mechanism to the small-crown forming position shown, the driver 206 is engaged with the small former/driver 214 and the large former 222 via the coupling members 210, 212. The driver 206 then drives the small former/driver 214 and the large former 222 downwardly, preferably in the direction of the driving path 246. The ramps 290 of the large bending portion 209 are displaced out of the path of the small side portions 216, and the small side portions 216 bend the pin 280 about the small bending block 205, as the large bending block 211 is no longer in the plane of the formed staple 296 and the formed staple 296 is consequently no longer disposed within the large crown recesses 279. The legs 298 of the staple 296 are guided in a fore and aft direction by the small guide tracks 250 of the small former/driver 214 and by the backplate 244. Also, during the forming of the pin 280 around the small bending block 205, the staple legs 298 are initially guided by a bottom portion 308 of the small guide track 250 that faces the leg portions 298 of the pin 280 prior to bending, which is shown in FIG. 26. The small guide track 250 is preferably rounded between the bottom portion 308 and the remainder thereof to facilitate the bending of the staple during this forming stage.

As the driver 206 is driven further downwardly along the driving path 246, both the small and large coupling members 210, 212 respectively contact the configuration ramps 274 and the fixed ramps 294, causing the fingers of the coupling members 210, 212 to move in a rearward direction and disengage from the small former/driver 214 and the large former. In an alternative embodiment, however, the large former may not be driven at all or may be disengaged at a different driving stage or forming when the stapler is in the small-crown configuration.

Figure 32:
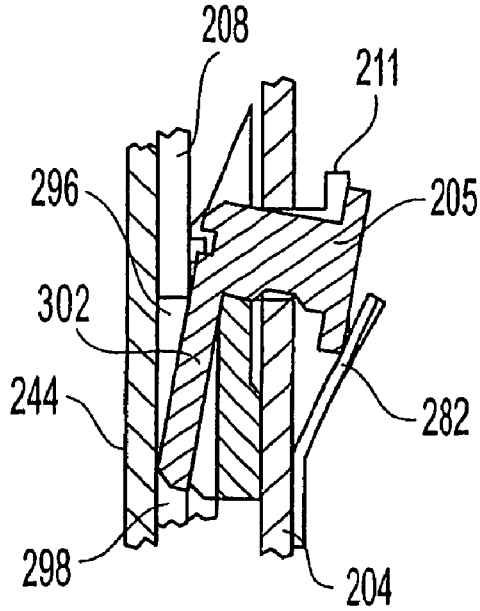
FIG. 32 is a partial cross-sectional view of the bending blocks during driving.

The lower edge of the driver blade 208 contacts and cams the ramp 288 of the small bending block 205 towards the faceplate 204, withdrawing the small bending block 205 from the driving path 246. The small bending block 205, as well as the large bending block 211, are preferably configured to rotate over a small angle, with the top portion of the bending blocks 205, 211 disposed further forward than the bottom. As shown in FIG. 27, both the small and large bending blocks 205, 211 preferably include rotating notches 300 facing downwardly to permit this rotation of the bending blocks 205, 211. As shown in FIG. 32, the small bending block 205 has been rotated towards the faceplate 204 by the driver blade 208, and the outer sides 302 of the small bending block 205 are in guiding contact with the staple legs 298 to keep the legs 298 from bending inwards and help direct them straight towards a workpiece and an anvil disposed beneath the staple 296. The springs 282 are preferably configured and associated with the bending blocks 205, 211 to assist in causing this rotation.

Figure 33:
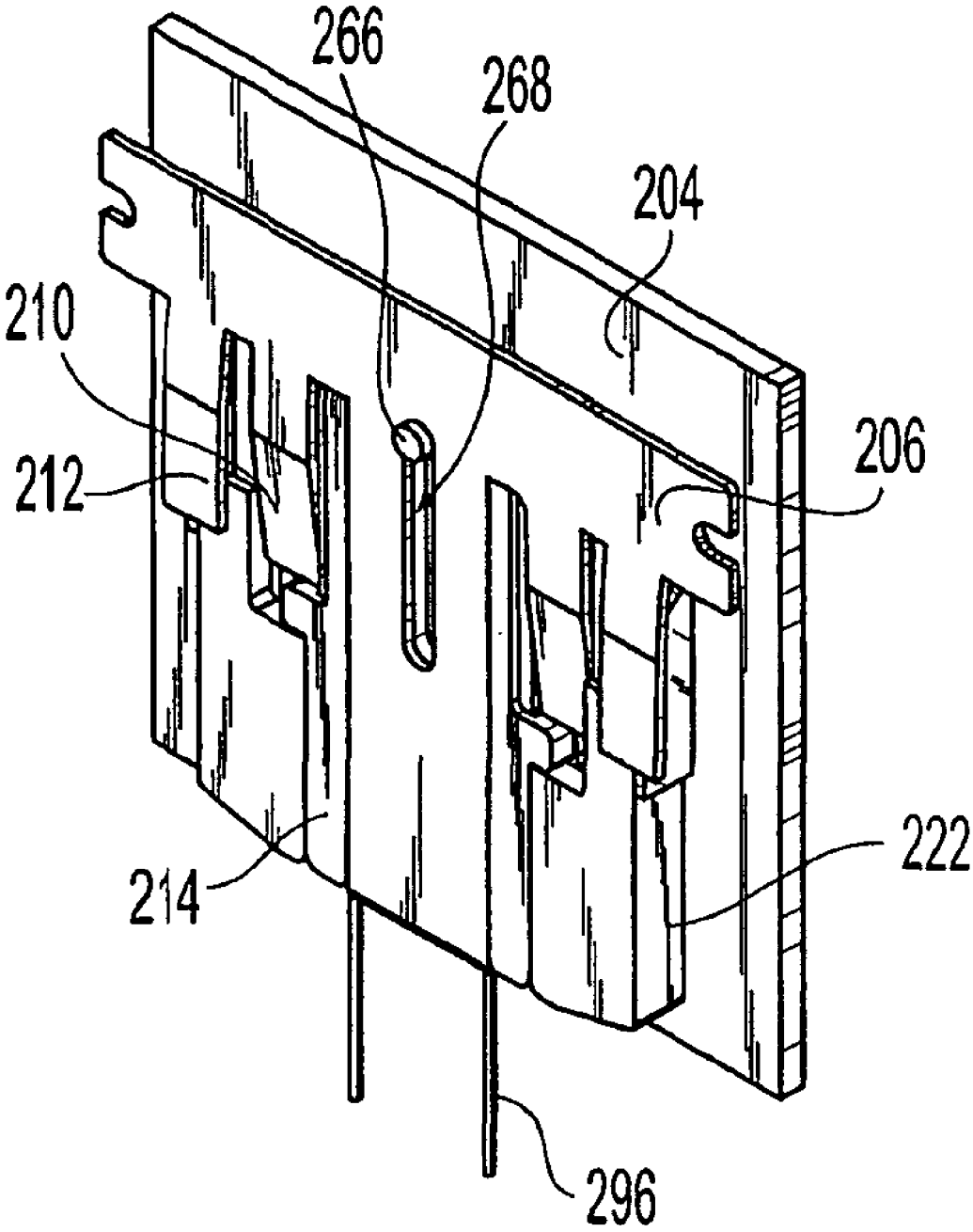
FIG. 33 is a perspective view of the driver/former assembly after driving a small-crown staple.

The driver 206 continues to be driven downward, driving the staple 296 downward through the workpiece and toward the anvil and staple bending mechanism. The staple 296 is shown in FIG. 33 without legs bent around the bottom of a workpiece for clarity, but it is understood that the legs would normally be so bent. At this bottom position of the drivers and formers 206, 214, 222, the bending blocks 205 and 211 are fully depressed against the faceplate 204, and the driver 206 has moved with respect to the large former 222 so that the lifting nub 266 is disposed at the upper end of the vertical slot 268. At this point, the driver is lifted, such as by the actuating mechanism or by a spring, to a position similar to that shown in FIG. 30, at which point the nub 266 abuts the bottom wall of the vertical slot 268. The driver 206 then begins to lift the large former 222 by the nub 266, which lifts the small former/driver due to the contact between the bottom surfaces 264 of the engagement members 260 of the small former/driver 214 with the lifting surfaces 263 of the large former 222. When the driver blade 208 and the small former/driver 214 have passed the respective depressed bending plates 205, 211, the bending plates 205, 211 move back to their original positions. This lifting continues until preferably all of the parts of the driver/former assembly 200 have returned to their original position, as shown in FIG. 25, and a new staple pin 280 is fed into the crown recesses 278, 279.

Figure 34:
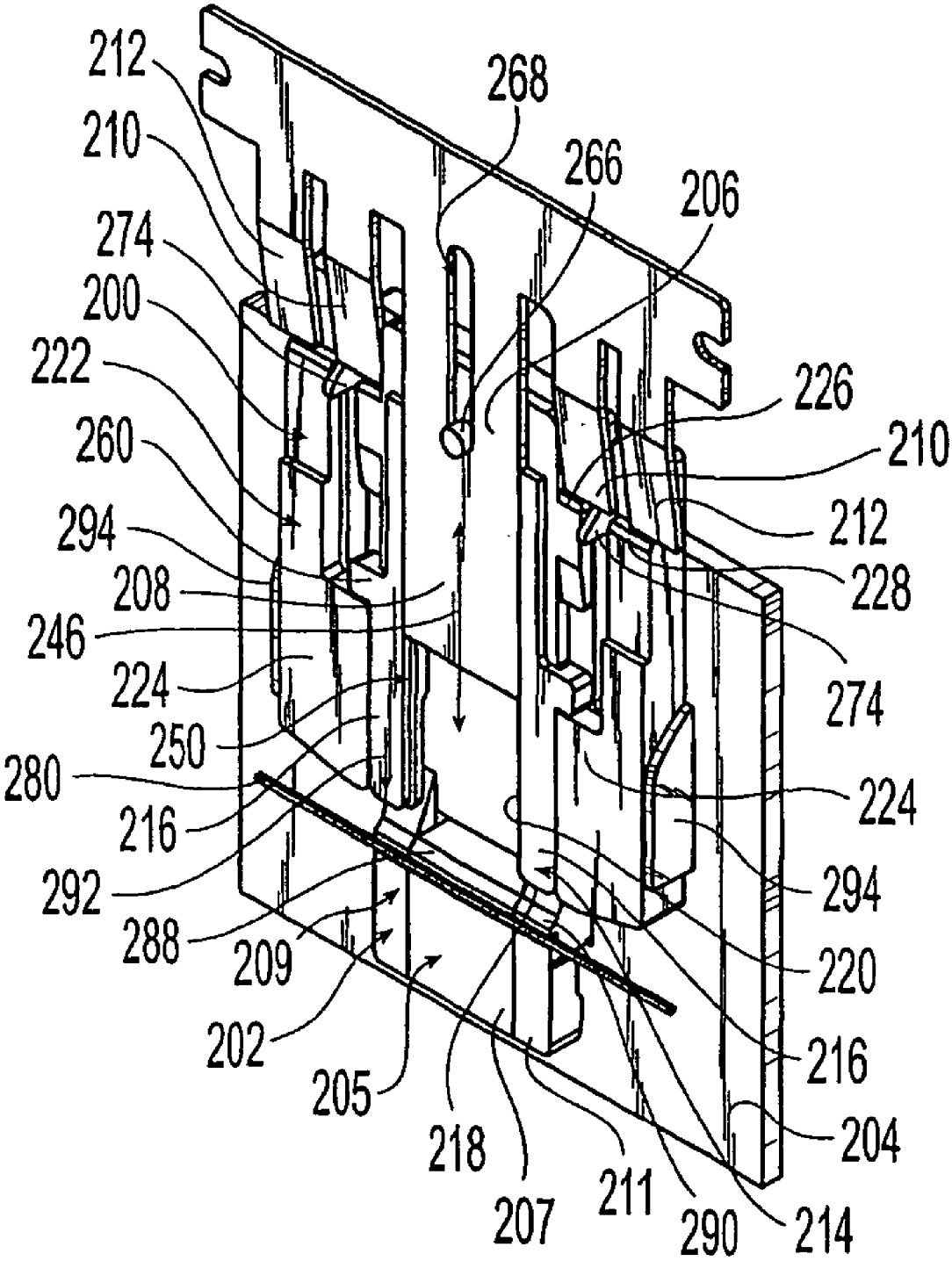
FIG. 34 is a perspective view of the driver/former assembly in a large-crown configuration and in the home position.

In FIG. 34, the driver/former assembly has been reconfigured to the large-crown configuration. The configuration ramps 274 have been moved upwards to locations substantially adjacent the small coupling members 210. The configuration ramps 274 can be repositioned by moving them upwardly, such as by sliding, or the stapler can have two sets of configuration ramps with only the lower set or the upper set protruding into the path of the coupling members 210 at any time.

When the driver 206 is driven downwardly in the large-crown configuration, the small coupling members 210 are disengaged near the beginning of the travel along the driving path 246 as they contact and are resiliently cammed by the configuration ramps 274. The large coupling members 212 drive the large former 222 downwardly.

Figure 35:
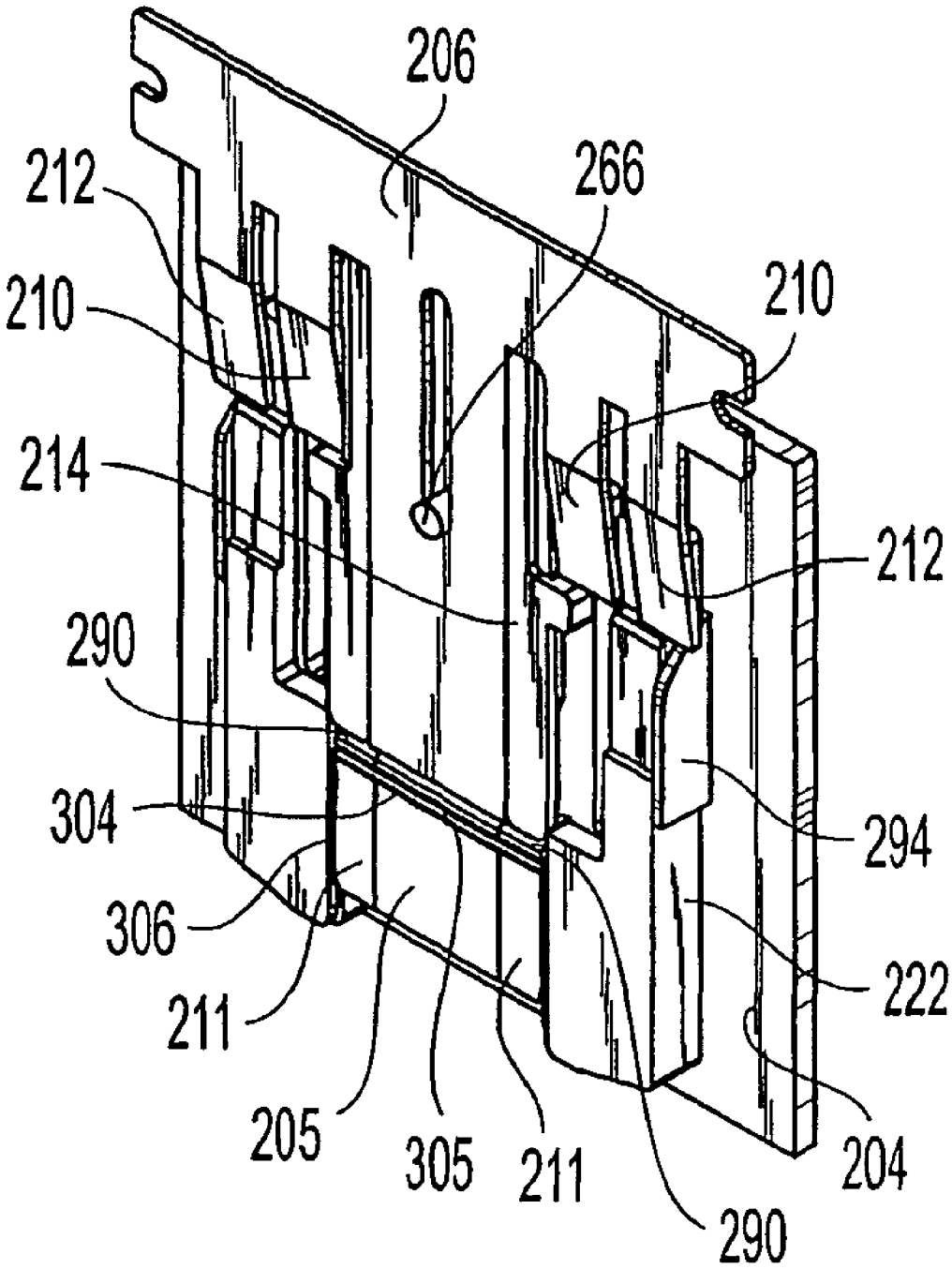
FIG. 35 is a perspective view thereof in a bending position.

Referring to FIG. 35, the large side portions 224 bend the pin 280 about the edges of the large bending block 211 to form a staple 304 with a large crown 305 and consequently shorter legs 306. The crown 305 is still preferably supported at its center by the small bending block 205. During the forming of the pin 280 around the large bending blocks 211, the staple legs 306 are initially guided by a bottom portion 310 of the large guide track 256 that faces the leg portions 306 of the pin 280 prior to bending, which are shown in FIG. 26. The large guide track 256 is preferably rounded between the bottom portion 310 and the remainder thereof to facilitate the bending of the staple during this forming stage.

The fingers of the small coupling members 210 reengage with the small former/driver 214, preferably by contacting the top surfaces 262 of the laterally extending engagement members 260. As the driver 206 is driven further downwardly, the fingers of large coupling members 212 are disengaged from the large former 222 as they are cammed backwards by the ramps 294. As the engagement members 260 are spaced from the lifting surfaces 263 of the large former 222, the small former/driver 214 can preferably move independently from the large former 222. When the driver blade 208 contacts the ramp 288, it cams the small bending block 205 towards the faceplate 204 and out of the driving path 246. Similarly, when the small former/driver 214 contacts ramps 290, it cams the large bending blocks 211 towards the faceplate 204 and out of the driving path 246, thereby allowing the staple crown 305 to exit the crown recesses 278, 279. Both the small and large bending blocks 205, 211 are allowed to rotate with their top portions angled towards the faceplate 204. The staple legs 306 are preferably supported and guided between the large guide tracks 256 of the large former 222, the backplate 244, and between the legs by the outer walls of the large bending plate 211.

Figure 36:
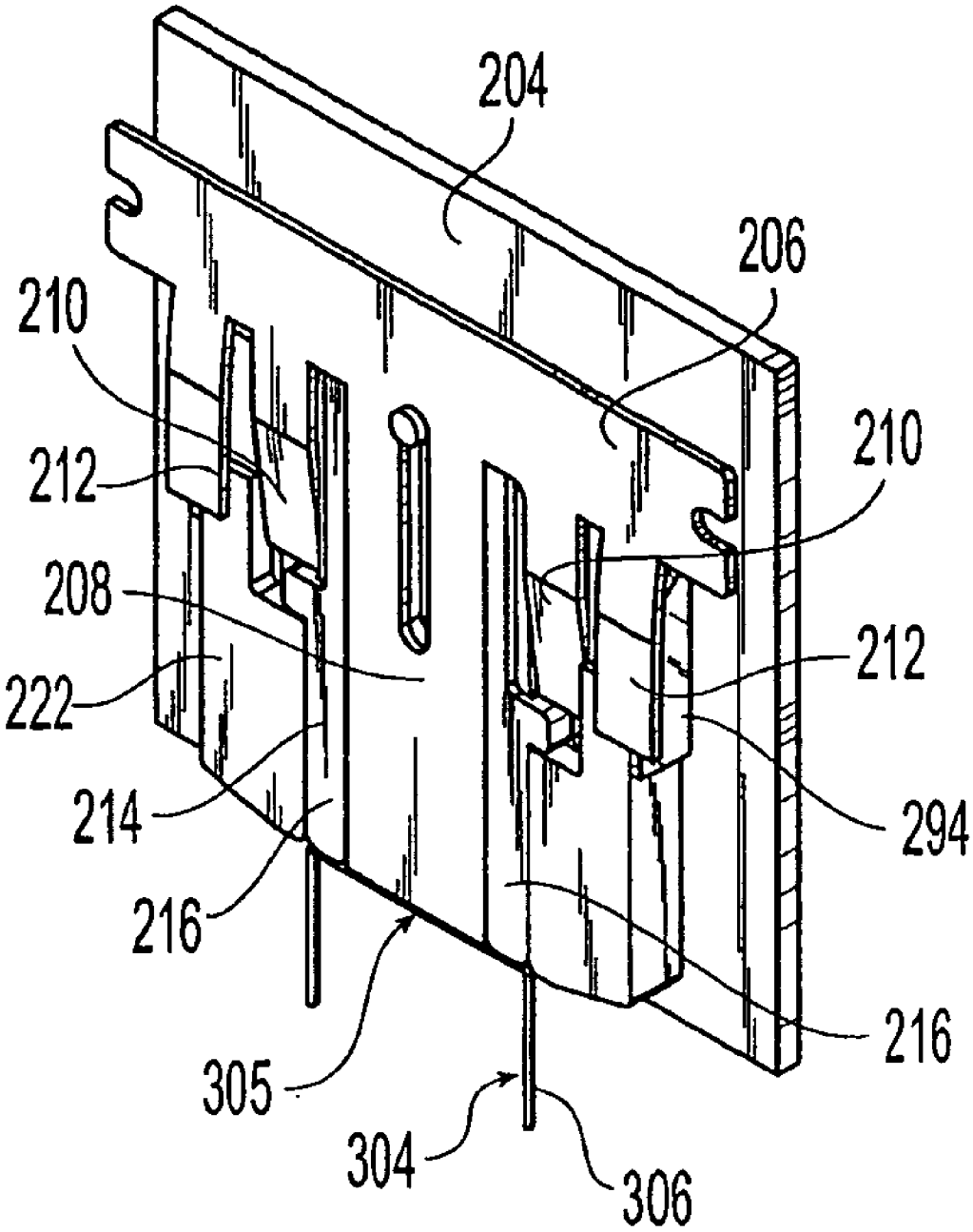
FIG. 36 is a perspective view of the driver/former assembly after driving a large-crown staple.

Referring to FIG. 36, as the driver 206 continues to move downwardly, both the driver blade 208 and the small former/driver 214 together define and act as a large driver. The leading bottom edges of the driver blade 208 and of the small side portions 216, which engage the staple 304 are preferably substantially horizontally aligned so that both contact the staple crown 305, although most of the driving force will generally be imparted on the crown 305 by the small side portions 216 of the small former/driver 214.

Once the staple 304 is fully driven into the workpiece and the legs 306 are bent around the opposite side of the workpiece, the driver/former assembly 200 is returned to its starting, home position shown in FIG. 25, as described above, with the configuration ramps 274 positioned in the small or large crown configuration positions.

Referring to FIGS. 30 and 35, the formers 214, 222 and the bending portions 205, 209 are preferably configured such that the lateral surfaces or walls thereof are long enough longitudinally, or vertically in the present case, to overlap with each other longitudinally when the staple is formed. Preferably, the surfaces of the formers and the bending blocks overlap over at least about 30%, and more preferably at least about 80% of the length of the staple legs. Also, the lateral walls of the formers that contact the staple legs are preferably longer in a longitudinal direction, along the driving path 246, than the lateral walls of the bending blocks, preferably by at least about 10% and more preferably by at least about 20%. Additionally, the formers preferably move longitudinally with respect to the lateral walls of the bending blocks over at least about 50% and more preferably over at least about 80% of the longitudinal length thereof, and most preferably over the entire longitudinal length thereof.

In the present embodiment described, movement from a single driver actuator drives all of the forming, bending, and driving assemblies. In an alternative embodiment, the different assemblies can be operated by different actuators. The actuators are preferably electric, but may alternatively be mechanically and/or manually moved, or may be powered and operated by another suitable source. Additionally, other embodiments have additional formers and former/drivers, actuatable in different sequences to form and drive staples with a crown size selected from a greater variety of crown sizes. Also, the formers are preferably not required to move laterally, or axially with respect to the preformed staple pin, to change crown configurations, but in some embodiments the formers have this ability.

The invention described and claimed herein is not to be limited in scope by the specific embodiments herein disclosed, since these embodiments are intended solely as illustrations of several aspects of the invention. Any equivalent embodiments are intended to be within the scope of this invention. Indeed, various modifications of the invention in addition to those shown and described herein will become apparent to those skilled in the art from the foregoing description. Such modifications are also intended to fall within the scope of the appended claims.

What is claimed is:

1. A stapler comprising:

a staple feeding mechanism that feeds staple blanks in a staple feed direction;

a staple former assembly configured to form staple blanks into staples; and a bend plate assembly that supports staple blanks and that is movable in the staple feed direction between a first position for forming staples having a first crown size and a second position for forming staples having a second crown size.

2. The stapler of claim 1, wherein the bend plate assembly includes a first portion defining a first bending surface for supporting staple blanks that are to be formed into staples having the first crown size; and a second portion defining a second bending surface for supporting staple blanks that are to be formed into staples having the second crown size.

3. The stapler of claim 2, wherein at least one of the first and second portions is movable in the staple feed direction to adjust the bend plate assembly between the first and second positions.

4. The stapler of claim 2, wherein the first and second portions move independently of one another.

5. The stapler of claim 2, wherein at least one of the first and second portions moves substantially linearly.

6. The stapler of claim 2, wherein at least one of the first and second portions is rotatable with respect to the other of the first and second portions.

7. The stapler of claim 2, wherein the second bending surface includes a pair of spaced-apart second bending surfaces, and wherein the first bending surface is disposed between the second bending surfaces.

8. The stapler of claim 7, wherein when the bend plate assembly is in the first position, the first bending surface is spaced from the second bending surfaces in a direction that is substantially parallel to the staple feed direction, and wherein when the assembly is in the second position, the first bending surface and the second bending surfaces are substantially aligned.

9. The stapler of claim 1, wherein the staple blank is bent about the bend plate assembly in a forming direction that is substantially perpendicular to the staple feed direction.

10. The stapler of claim 1, wherein the staple former assembly is movable in the staple feed direction between a first position for forming staples having the first crown size and a second position for forming staples having the second crown size.

11. The stapler of claim 1, wherein the staple former assembly includes a first portion having a pair of first forming surfaces spaced apart a first distance for forming staples having the first crown size, and a second portion having a pair of second forming surfaces spaced apart a second distance for forming staples having the second crown size.

12. The stapler of claim 1, wherein the staple former assembly includes a first former configured to form staples having the first crown size and configured to drive staples having the second crown size toward a stapling area, and a second former configured to form staples having the second crown size.

13. The stapler of claim 1, further comprising:

a staple driver assembly for driving staples, the staple driver assembly being movable between a first configuration for driving staples having the first crown size and a second configuration for driving staples having the second crown size.

14. The stapler of claim 1, further comprising:

a staple driver assembly for driving staples having the first crown size and the second crown size into an item to be stapled, the staple driver assembly including a driver having a driving surface for movement in a driving direction to drive staples into the item, the driving surface having a first driving width in a first configuration of the driver assembly for driving staples having the first crown size, and a second driving width in a second configuration of the driver assembly for driving staples having the second crown size.

15. A stapler comprising:

a staple feeding mechanism that feeds staple blanks in a staple feed direction; and a staple former assembly configured to form staple blanks into staples; and a bend plate assembly that supports staple blanks for forming staples having a first crown size and a second crown size, the bend plate assembly including a first portion defining a first bending surface having a first width for forming staples having the first crown size; and a second portion defining a second bending surface having a second width for forming staples having the second crown size.

16. The stapler of claim 15, wherein at least one of the first and second portions moves to adjust the bend plate assembly between a first position for forming staples having the first crown size, and a second position for forming staples having the second crown size.

17. The stapler of claim 16, wherein the first and second portions move independently of one another.

18. The stapler of claim 16, wherein the staple blank is bent about the bend plate assembly in a forming direction, and wherein at least one of the first and second portions moves in a direction that is substantially perpendicular to the forming direction to adjust the bend plate assembly between the first and second positions.

19. The stapler of claim 15, wherein the second bending surface includes a pair of spaced apart second bending surfaces, and wherein the first bending surface is disposed between the second bending surfaces.

20. The stapler of claim 15, wherein the first and second bending surfaces are substantially co-planar.

21. The stapler of claim 15, wherein the staple former assembly is movable in the staple feed direction between a first position for forming staples having the first crown size and a second position for forming staples having the second crown size.

22. The stapler of claim 15, wherein the staple former assembly includes a first portion having a pair of first forming surfaces spaced apart a first distance for forming staples having the first crown size, and a second portion having a pair of second forming surfaces spaced apart a second distance for forming staples having the second crown size.

23. The stapler of claim 15, wherein the staple former assembly includes a first former configured to form staples having the first crown size and configured to drive staples having the second crown size toward a stapling area, and a second former configured to form staples having the second crown size.

24. The stapler of claim 15, further comprising:

a staple driver assembly for driving staples, the staple driver assembly being movable between a first configuration for driving staples having the first crown size and a second configuration for driving staples having the second crown size.

25. The stapler of claim 15, further comprising:

a staple driver assembly for driving staples having the first crown size and the second crown size into an item to be stapled, the staple driver assembly including a driver having a driving surface for movement in a driving direction to drive staples into the item, the driving surface having a first driving width in a first configuration of the driver assembly for driving staples having the first crown size, and a second driving width in a second configuration of the driver assembly for driving staples having the second crown size.

* * * * *